US006738589B2

(12) United States Patent
Karakama et al.

(10) Patent No.: US 6,738,589 B2
(45) Date of Patent: May 18, 2004

(54) PROCESS CARTRIDGE INCLUDING CONVEX AND CONCAVE PORTIONS AND ELECTROPHOTOGRAPHIC IMAGE FORMING APPARATUS TO WHICH SUCH A PROCESS CARTRIDGE IS DETACHABLY MOUNTABLE

(75) Inventors: Toshiyuki Karakama, Shizuoka (JP); Kazushi Watanabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/022,904

(22) Filed: Dec. 20, 2001

(65) Prior Publication Data

US 2002/0081125 A1 Jun. 27, 2002

(30) Foreign Application Priority Data

Dec. 22, 2000 (JP) ..... 2000-391135

(51) Int. Cl.[7] ..... G03G 21/16
(52) U.S. Cl. ..... 399/111
(58) Field of Search ..... 399/107, 111, 399/113, 114, 116, 117

(56) References Cited

U.S. PATENT DOCUMENTS

| | | | | |
|---|---|---|---|---|
| 5,095,335 | A | 3/1992 | Watanabe et al. | 355/210 |
| 5,151,734 | A | 9/1992 | Tsuda et al. | 355/200 |
| 5,208,634 | A | 5/1993 | Ikemoto et al. | 355/215 |
| 5,223,893 | A | 6/1993 | Ikemoto et al. | 355/200 |
| 5,294,960 | A | 3/1994 | Nomura et al. | 355/210 |
| 5,331,372 | A | 7/1994 | Tsuda et al. | 355/200 |
| 5,345,294 | A | 9/1994 | Nomura et al. | 355/200 |
| 5,404,198 | A | 4/1995 | Noda et al. | 355/200 |
| 5,455,665 | A | 10/1995 | Baba et al. | 355/298 |
| 5,463,446 | A | 10/1995 | Watanabe et al. | 355/200 |
| 5,465,136 | A | 11/1995 | Watanabe et al. | 355/210 |
| 5,470,635 | A | 11/1995 | Shirai et al. | 428/131 |
| 5,475,470 | A | 12/1995 | Sasago et al. | 355/210 |
| 5,488,459 | A | 1/1996 | Tsuda et al. | 355/211 |
| 5,500,714 | A | 3/1996 | Yashiro et al. | 355/200 |
| 5,510,878 | A | 4/1996 | Noda et al. | 355/211 |
| 5,543,898 | A | 8/1996 | Shishido et al. | 355/210 |
| 5,561,504 | A | 10/1996 | Watanabe et al. | 355/215 |
| 5,583,613 | A | 12/1996 | Kobayashi et al. | 355/200 |
| 5,585,895 | A | 12/1996 | Yashiro et al. | 355/215 |
| 5,602,623 | A | 2/1997 | Nishibata et al. | 399/111 |
| 5,608,509 | A | 3/1997 | Shirai et al. | 399/351 |
| 5,617,579 | A | 4/1997 | Yashiro et al. | 399/114 |
| 5,623,328 | A | 4/1997 | Tsuda et al. | 399/111 |
| 5,640,650 | A | 6/1997 | Watanabe et al. | 399/117 |
| 5,659,847 | A | 8/1997 | Tsuda et al. | 399/113 |
| 5,669,042 | A | 9/1997 | Kobayashi et al. | 399/111 |
| 5,689,774 | A | 11/1997 | Shishido et al. | 399/111 |
| 5,749,027 | A | 5/1998 | Ikemoto et al. | 399/113 |
| 5,768,658 | A | 6/1998 | Watanabe et al. | 399/111 |

(List continued on next page.)

*Primary Examiner*—Hoan Tran
(74) *Attorney, Agent, or Firm*—Fitzpatrick, Cella, Harper & Scinto

(57) ABSTRACT

A process cartridge detachably mountable to an electrophotographic image forming apparatus main body, includes: an electrophotographic photosensitive drum; a process member for acting on the electrophotographic photosensitive drum; a frame for holding the electrophotographic photosensitive drum; convex portions, which are provided coaxially with an axis of the electrophotographic photosensitive drum and protrude from one side and from the other side of the frame, for positioning the process cartridge in the apparatus main body when the process cartridge is mounted to the apparatus main body, and a concave portion provided in the upper part of the frame and recessed in the one side, in which the concave portion allows the process cartridge to be inserted into the apparatus main body without abutting against a protrusion provided in the apparatus main body in an inserting process of the process cartridge.

13 Claims, 23 Drawing Sheets

U.S. PATENT DOCUMENTS 5,768,660 A 6/1998 Kurihara et al. ..... 399/111
5,774,766 A 6/1998 Karakama et al. ..... 399/111
5,790,923 A 8/1998 Oguma et al. ..... 399/106
5,794,101 A 8/1998 Watanabe et al. ..... 399/103
5,809,374 A 9/1998 Tsuda et al. ..... 399/111
5,812,909 A 9/1998 Oguma et al. ..... 399/103
5,828,928 A 10/1998 Sasago et al. ..... 399/111
5,878,304 A 3/1999 Watanabe et al. ..... 399/92
5,878,310 A 3/1999 Noda et al. ..... 399/117
5,884,124 A 3/1999 Karakama et al. ..... 399/123
5,890,036 A 3/1999 Karakama et al. ..... 399/119
5,899,602 A 5/1999 Noda et al. ..... 399/111
5,903,803 A 5/1999 Kawai et al. ..... 399/116
5,920,752 A 7/1999 Karakama et al. ..... 399/111
5,930,562 A * 7/1999 Noda et al. ..... 399/114
5,937,242 A 8/1999 Yokoyama et al. ..... 399/114
5,943,528 A 8/1999 Akutsu et al. ..... 399/110
5,966,566 A 10/1999 Odagawa et al. ..... 399/109
5,966,568 A 10/1999 Numagami et al. ..... 399/111
6,006,058 A 12/1999 Watanabe et al. ..... 399/167
6,016,413 A 1/2000 Yokoyama et al. ..... 399/113
6,029,032 A 2/2000 Watanabe et al. ..... 399/107
6,032,007 A 2/2000 Yamaji et al. ..... 399/104
6,070,028 A 5/2000 Odagawa et al. ..... 399/104
6,075,956 A 6/2000 Watanabe et al. ..... 399/92
6,097,908 A 8/2000 Uchiyama et al. ..... 399/111
6,097,909 A 8/2000 Watanabe et al. ..... 399/111
6,101,354 A 8/2000 Nakagawa et al. ..... 399/225
6,118,960 A 9/2000 Nakagawa et al. ..... 399/111
6,128,454 A 10/2000 Kawai et al. ..... 399/116
6,144,398 A 11/2000 Yokoyama et al. ..... 347/263
6,160,976 A 12/2000 Karakama et al. ..... 399/104
6,163,665 A 12/2000 Watanabe et al. ..... 399/111
6,169,866 B1 1/2001 Watanabe et al. ..... 399/111
6,175,706 B1 1/2001 Watanabe et al. ..... 399/167
6,226,478 B1 5/2001 Watanabe et al. ..... 399/117
6,236,821 B1 5/2001 Yokoyama et al. ..... 399/113
6,240,266 B1 5/2001 Watanabe et al. ..... 399/117
6,246,849 B1 6/2001 Yokoyama et al. ..... 399/117
6,253,036 B1 6/2001 Karakama et al. ..... 399/27
6,266,500 B1 7/2001 Numagami et al. ..... 399/104
6,272,299 B1 8/2001 Numagami et al. ..... 399/111
6,324,363 B1 11/2001 Watanabe et al. ..... 399/111
6,330,402 B1 12/2001 Sakurai et al. ..... 399/12
6,330,409 B1 12/2001 Watanabe et al. ..... 399/111
6,336,018 B1 1/2002 Kawai et al. ..... 399/117
6,366,749 B1 * 4/2002 Koumoto ..... 399/113
6,418,292 B1 * 7/2002 Isobe et al. ..... 399/258

* cited by examiner

PROCESS CARTRIDGE INCLUDING CONVEX AND CONCAVE PORTIONS AND ELECTROPHOTOGRAPHIC IMAGE FORMING APPARATUS TO WHICH SUCH A PROCESS CARTRIDGE IS DETACHABLY MOUNTABLE

BACKGROUND OF THE INVENTION

1. Field of the Invention

The present invention relates to an electrophotographic image forming apparatus using an electrophotographic process and to a process cartridge.

Here, the electrophotographic image forming apparatus is an apparatus for forming an image on a recording medium using an electrophotographic image forming process. The electrophotographic image forming apparatus includes, for example, an electrophotographic copying machine, an electrophotographic printer (e.g., a laser beam printer, an LED printer and the like), a facsimile apparatus, a word processor and the like.

In addition, the process cartridge may be a cartridge into which charging means, developing means or cleaning means and an electrophotographic photosensitive member are integrally incorporated, and which is detachably mountable to an image forming apparatus main body. Alternatively, the process cartridge may be a cartridge into which at least one of charging means, developing means and cleaning means and an electrophotographic photosensitive member are integrally incorporated, and which is detachably mountable to an image forming apparatus main body. Further alternatively, the process cartridge may be a cartridge into which at least developing means and an electrophotographic photosensitive member are integrally incorporated, and which is detachably mountable to an image forming apparatus main body.

2. Description of Related Art

Conventionally, in an image forming apparatus using an electrophotographic image forming process, a process cartridge system is employed, which makes an electrophotographic photosensitive member and process means acting on the electrophotographic photosensitive member integrally into a cartridge which is detachably mountable to an electrophotographic image forming apparatus main body. According to the process cartridge system, since a user can carry out maintenance of an apparatus in person without relying on service personnel, operability can be remarkably improved. Thus, the process cartridge system is widely used in the electrophotographic image forming apparatuses.

Incidentally, in recent years, various kinds of image forming apparatuses have come to be manufactured in a short period of time accompanied with changes in needs in the market.

Therefore, manufacturers cope with the shortened manufacturing cycle by frequently making apparatus parts into a common part. In addition, the manufacturers improve only parts corresponding to a new specification of a new product to further make the parts into a common part and obtain advantages in terms of time and costs.

However, if making the parts into a common part or sharing of parts is advanced as described above, there is less difference between forms of new and old in units such as a process cartridge, which makes the units mountable to new and old image forming apparatus main bodies. In this case, if a new specification of a new image forming apparatus main body includes increase of speed and the like, when an old process cartridge is mounted to the flew image forming apparatus main body, there is a fear that the old process cartridge cannot cope with the speed sufficiently.

SUMMARY OF THE INVENTION

It is an object of the present invention to provide an image forming apparatus to which a process cartridge of a different specification is made unmountable if the image forming apparatus cannot cope sufficiently with the specifications of the process cartridge when the process cartridge is mounted.

It is another object of the present invention to provide an image forming apparatus to which a process cartridge of low speed performance is unmountable and a process cartridge of high speed performance is mountable.

It is still another object of the present invention to provide a process cartridge that is mountable to an image forming apparatus of a different specification only if the process cartridge can cope with the specification when it is mounted to the image forming apparatus.

It is a further object of the present invention to provide a process cartridge that is mountable even to an image forming apparatus of lower speed performance.

It is a still further object of the present invention to provide a process cartridge comprising:

an electrophotographic photosensitive drum;

processing means for acting on the electrophotographic photosensitive drum;

a frame for holding the electrophotographic photosensitive drum;

convex portions, which are provided coaxially with an axis of the electrophotographic photosensitive drum and protrude from one side and from the other side of the frame, for positioning the process cartridge in the apparatus main body when the process cartridge is mounted to the electrophotographic image forming apparatus main body; and a concave portion provided in the upper part of the frame and recessed in the one side, in which the concave portion allows the process cartridge to be inserted into the apparatus main body without abutting against a protrusion provided in the apparatus main body in an inserting process of the process cartridge.

It is another object of the present invention to provide an electrophotographic image forming apparatus comprising:

(a) a protrusion provided on an internal wall surface of the apparatus main body;

(b) mounting means for detachably mounting a process cartridge, wherein the process cartridge includes an electrophotographic photosensitive drum, processing means for acting on the electrophotographic photosensitive drum, a frame for holding the electrophotographic photosensitive drum, convex portions, which are provided coaxially with an axis of the electrophotographic photosensitive drum and which protrude from one side and from the other side of the frame, for positioning the process cartridge in the apparatus main body when the process cartridge is mounted to the apparatus main body and a concave portion provided in the upper part of the frame and recessed in the one side, in which the concave portion allows the process cartridge to be inserted into the image forming apparatus main body without abutting against the protrusion in an inserting process of the process cartridge; and (c) conveying means for conveying the recording medium.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

A process cartridge and an image forming apparatus in accordance with the present invention will be described in detail with reference to the accompanying drawings.

In the following embodiments, first and second process cartridges B1 and B2 and first and second image forming apparatuses A1 and A2 will be described. The first process cartridge B1 is configured to be used in the first image forming apparatus A1 that is a low to medium speed machine, and the second process cartridge B2 is configured to be used in the second image forming apparatus A2 that is a high speed machine. However, the first and the second process cartridges B1 and B2 and the first and the second image forming apparatuses A1 and A2 have basically the same configuration, respectively.

Further, in the following description, a latitudinal direction of the first and the second process cartridges B1 and B2 is a direction in which the first and the second process cartridges B1 and B2 are mounted to and detached from first and second image forming apparatus main bodies (hereinafter simply referred to as "apparatus main bodies") 14 and 214, and coincides with a conveying direction of a recording medium. In addition, a longitudinal direction of the first and the second process cartridges B1 and B2 is a direction crossing (substantially perpendicular to) the direction in which the first and the second process cartridges B1 and B2 are mounted to and detached from the first and the second apparatus main bodies 14 and 214, and is a direction crossing (substantially perpendicular to) the conveying direction of a recording medium. Further, right or left with respect to the first and the second process cartridges B1 and B2 is right or left of the recording medium along the conveying direction of the recording medium when it is viewed from above.

In addition, in the following description, the upper surfaces of the first and the second process cartridges B1 and B2 are surfaces positioned upward in the state in which the first and the second process cartridges B1 and B2 are mounted to the firs and the second apparatus main bodies 14 aid 214, and the lower surfaces are surfaces positioned below.

[Configurations and Operations for Forming an Image of an Image Forming Apparatus and a Process Cartridge]

First, an embodiment of the first and the second electrophotographic image forming apparatuses (laser beam printers) to which the present invention is applied will be described with reference to FIG. 1. Note that, since configurations relating to image formation are common for the first and the second image forming apparatuses and the first and the second process cartridges, respectively, the embodiment will be described here using the first image forming apparatus A1 and the first process cartridge B1, and description of the second image forming apparatus A2 and the second process cartridge B2 are omitted. Therefore, the distinction of "first" and "second" is also omitted here.

Figure 1:
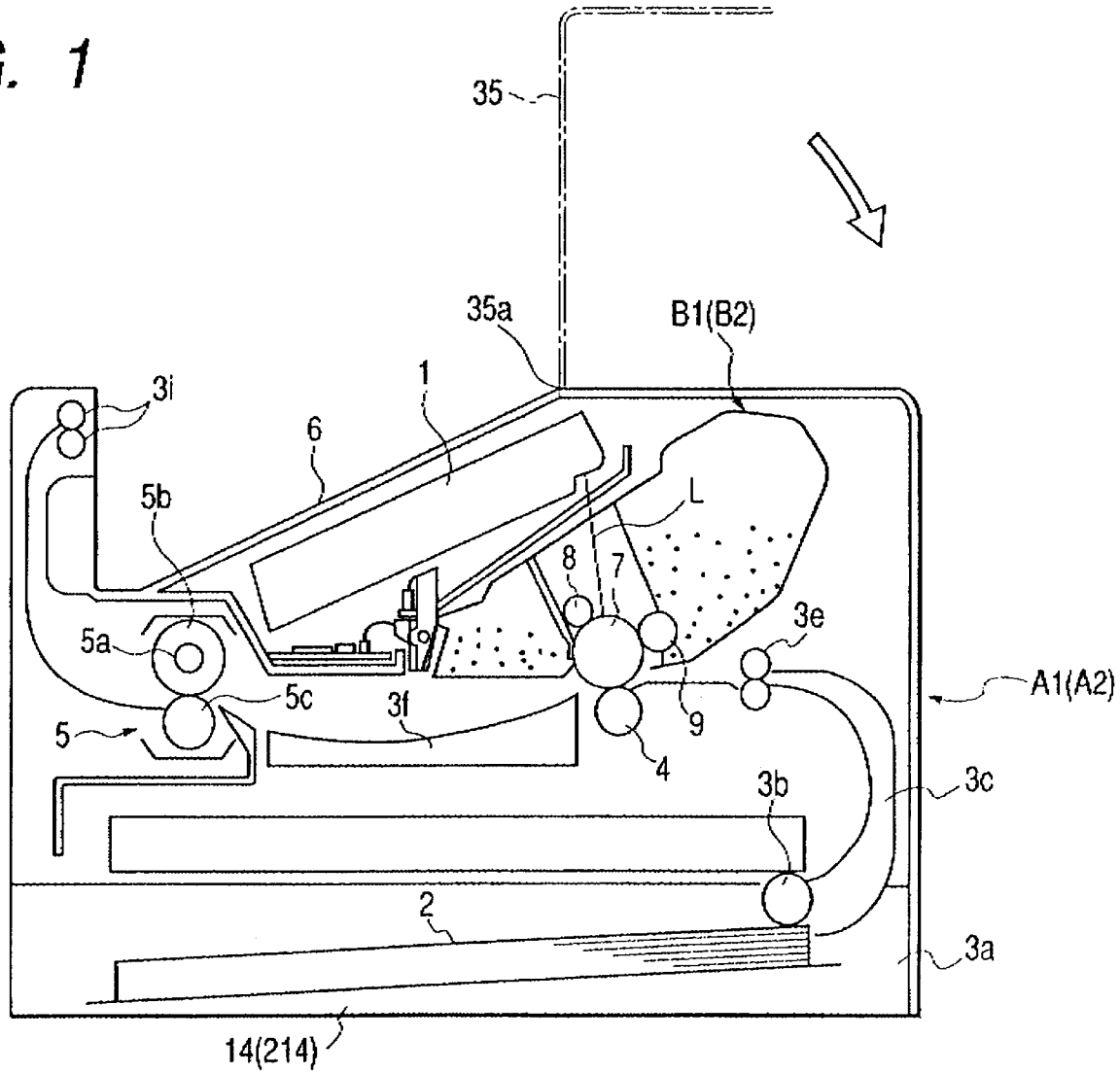
FIG. 1 is a side view showing a configuration of an embodiment of an electrophotographic image forming apparatus according to the present invention.

As shown in FIG. 1, the laser beam printer A1 is a printer for forming an image on a recording medium (e.g., recording paper, an OHP sheet, cloth and the like) 2 by the electrophotographic image forming process. A toner image is formed on an electrophotographic photosensitive member of a drum shape (hereinafter referred to as "photosensitive drum") 7. More specifically, the photosensitive drum 7 is charged by charging means 8, and then a laser beam L modulated according to image information from optical means 1 irradiates the photosensitive drum 7 to form a latent image corresponding to the image information on the photosensitive drum 7. Then, the latent image is developed by developing means 9 to form a toner image.

On the other hand, in synchronism with the formation of the toner image, the recording medium 2 set in a feeding cassette 3*a* is reversely conveyed by a pick-up roller 3*b*, a conveying guide 3*c* and a pair of registration rollers 3*e*. Subsequently, the toner image formed on the photosensitive drum 7 held by the process cartridge B1 is transferred to the recording medium 2 by applying a voltage to a transfer roller 4 as transferring means.

Thereafter, the recording medium 2 to which the toner image has been transferred is conveyed to fixing means 5 by a conveying guide 3*f*. The fixing means 5 has a driving roller 5*c* and a fixing roller 5*b* incorporating a heater 5*a*. Then, the fixing means 5 fixes the transferred toner image by applying heat and pressure to the recording medium 2 passing through the fixing means 5. Then, the recording medium 2 is conveyed by a pair of discharge rollers 3*i* and discharged to a discharge tray 6.

Next, the process cartridge B1 will be described with reference to FIG. 2.

The process cartridge B1 rotates the photosensitive drum 7 having a photoconductive layer 7*e* to uniformly charge the surface of the photosensitive drum 7 by applying a voltage to a charging roller 8 that is charging means. Subsequently, a laser beam modulated according to image information from an optical system 1 irradiates the photosensitive drum 7 via an exposure opening 1*e* to form a latent image. Then, the latent image is developed by the developing means 9 using toner. More specifically, the charging roller 8 is provided in contact with the photosensitive drum 7 to charge the photosensitive drum 7. Further, the charging roller 8 is driven by the photosensitive drum 7 to rotate. In addition, the developing means 9 supplies toner to a developing area of the photosensitive drum 7 to develop the latent image formed on the photosensitive drum 7.

The developing means 9 delivers toner in a toner container 11A to a developing roller 9*c* by rotation of a toner feeding member 9*b*. Then, the developing means 9 rotates the developing roller 9*c* incorporating a stationary magnet, and at the same time forms a toner layer in which triboelectification charges are induced by a developing blade 9*d* and supplies the toner to the developing area of the photosensitive drum 7. Then, the developing means 9 causes the toner to move to the photosensitive drum 7 according to the latent image, thereby forming and visualizing a toner image.

The developing blade 9*d* is a blade for regulating a toner amount on the peripheral surface of the developing roller 9*c*, and at the same time inducing triboelectification charges in the toner. In addition, a toner agitating member 9*e* for circulating the toner in a developing chamber 9*f* is rotatably attached to the vicinity of the developing roller 9*c*.

Subsequently, a voltage of polarity opposite to that of the toner image is applied to the transfer roller 4 to transfer the toner image formed on the photosensitive drum 7 to the recording medium 2, and thereafter the residual toner on the photosensitive drum 7 is removed by cleaning means 10. The cleaning means 10 scrapes off the toner remained on the photosensitive drum 7 by an elastic cleaning blade 10*a* being abutted against the photosensitive drum 7 to collect the toner in a waste toner reservoir 10*b*.

[Configuration of a Housing of the Process Cartridge]

Next, a configuration of housings of the first and the second process cartridges B1 and B2 in accordance with the embodiment will be described. Description of the configuration of the housing of the second process cartridge B2 is omitted because it is the same as that of the first process cartridge B1. Therefore, distinction or "first" and "second" is also omitted here.

In the process cartridge B1, a toner frame 11 having a toner container (toner containing portion) 11A for containing toner is connected with a developing frame 12 for holding the developing means 9 such as the developing roller 9*c*. Then, the process cartridge B1 has a housing that is configured by rotatably connecting the combination of toner frame 11 and the developing frame 12 to a cleaning frame. 13, to which the photosensitive drum 7, the cleaning means 10 such as the cleaning blade 10*a* and the charging roller 8 are attached. The process cartridge B1 is detachably mounted to cartridge mounting means provided in the apparatus main body 14. The cartridge mounting means will be described in detail later.

The process cartridge B1 is provided with the exposure opening 1*e* for irradiating the photosensitive drum 7 with a laser beam modulated according to image information and a transfer opening 13*n* for opposing the photosensitive drum 7 to the recording medium 2. More specifically, the exposure opening 1*e* is provided in the cleaning frame 13 and the transfer opening 13*n* is formed between the developing frame 12 and the cleaning frame 13.

Figure 2:
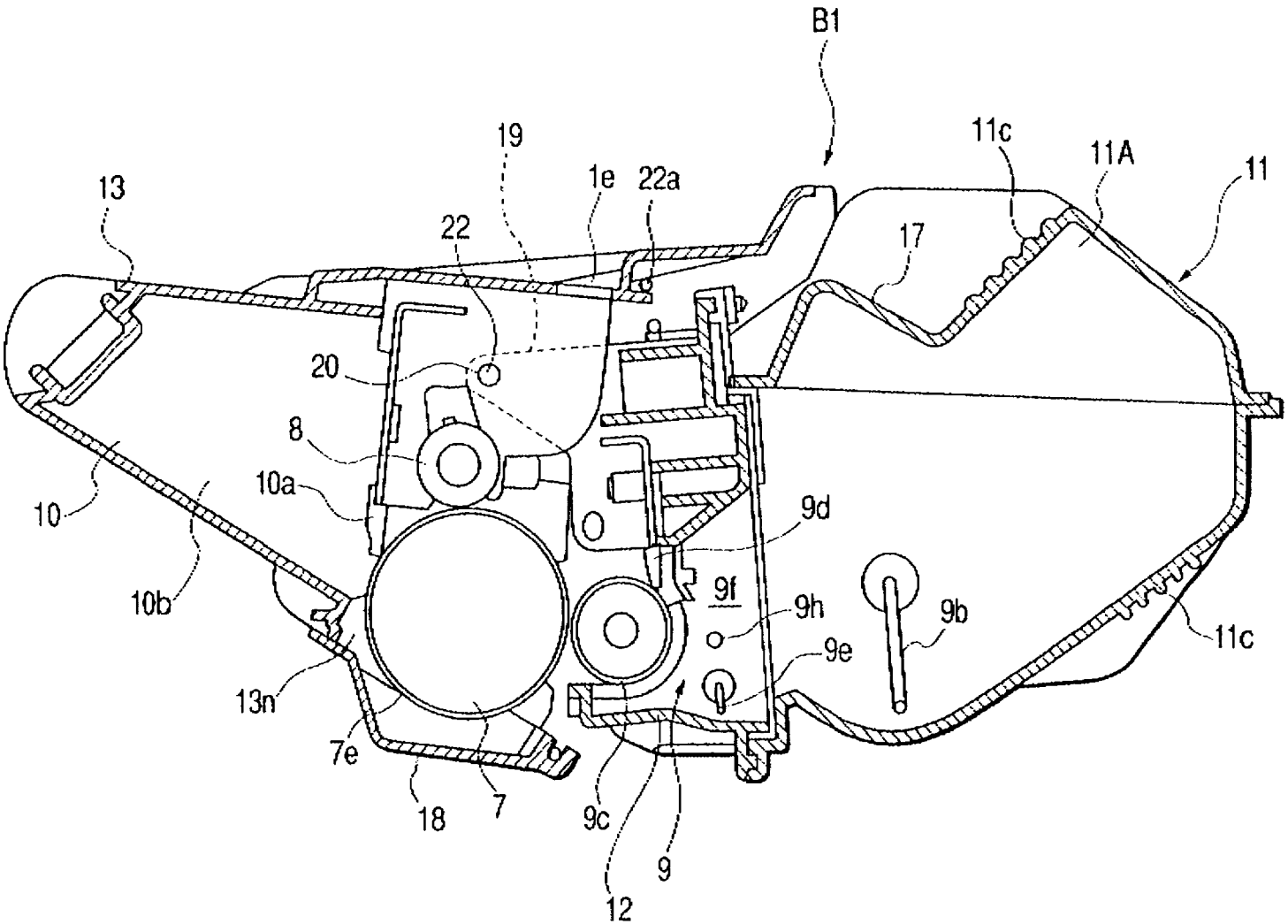
FIG. 2 is a side sectional view showing an embodiment of a first process cartridge according to the present invention.
Figure 3:
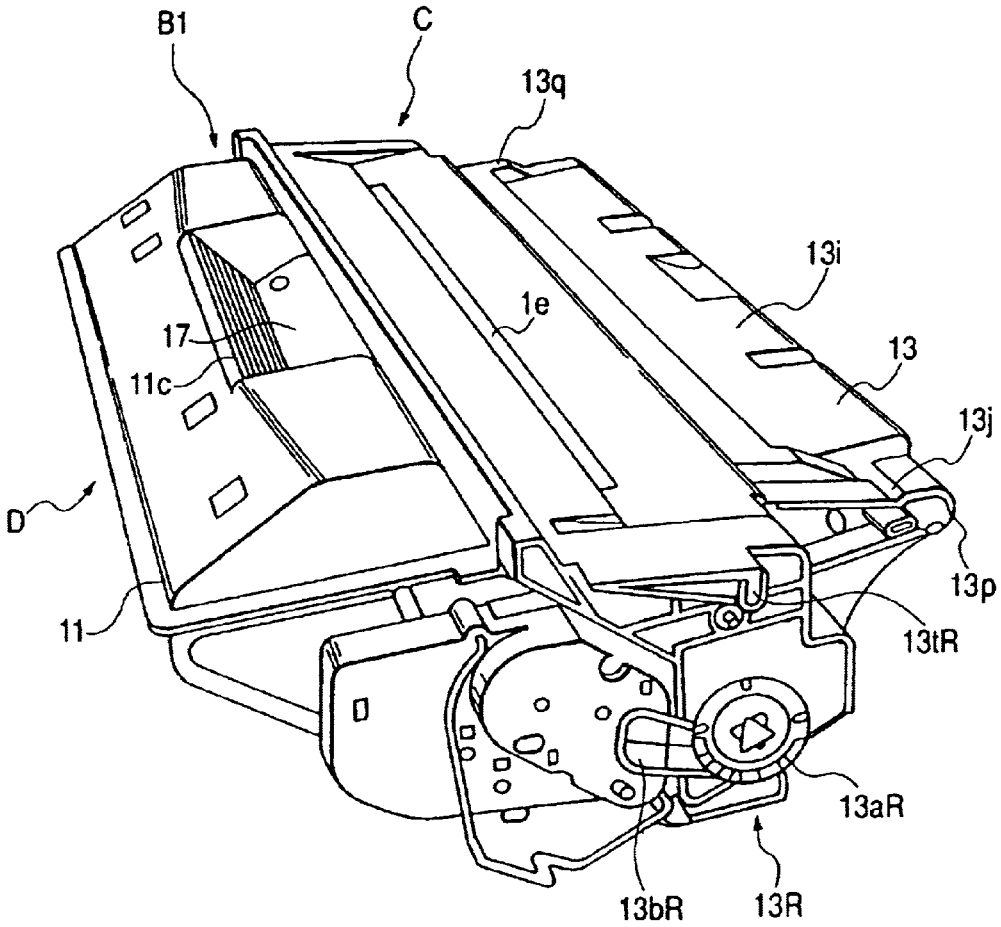
FIG. 3 is a perspective view of the first process cartridge as looking from an upper right-hand side.

As shown in FIGS. 2 and 3, the toner feeding member 9*b* is rotatably attached to the toner frame 11. In addition, the developing roller 9*c* and the developing blade 9*d* are attached to the developing frame 12. Moreover, the toner agitating member 9*e* for circulating the toner in the developing chamber 9*f* is rotatably attached to the vicinity of the developing roller 9*c*. Further, an antenna rod 9*h* for toner amount detection is attached to the developing frame 12 in the longitudinal direction of the developing roller 9*c*. The antenna rod 9*h* is opposed to and substantially parallel to the developing roller 9*c*. Then, the toner frame 11 and the developing frame 12 are welded (by ultrasonic welding in the embodiment) to form a developing unit D as an integral second frame (see FIG. 13).

Note that, a drum shutter member 18 is attached to the developing unit D. The drum shutter member 18 is a member for covering the photosensitive drum 7 when the process cartridge B1 is detached from the image forming apparatus main body 14 and protecting the photosensitive drum 7 from exposure to light for a long time, contact with a foreign substance and the like.

Figure 12:
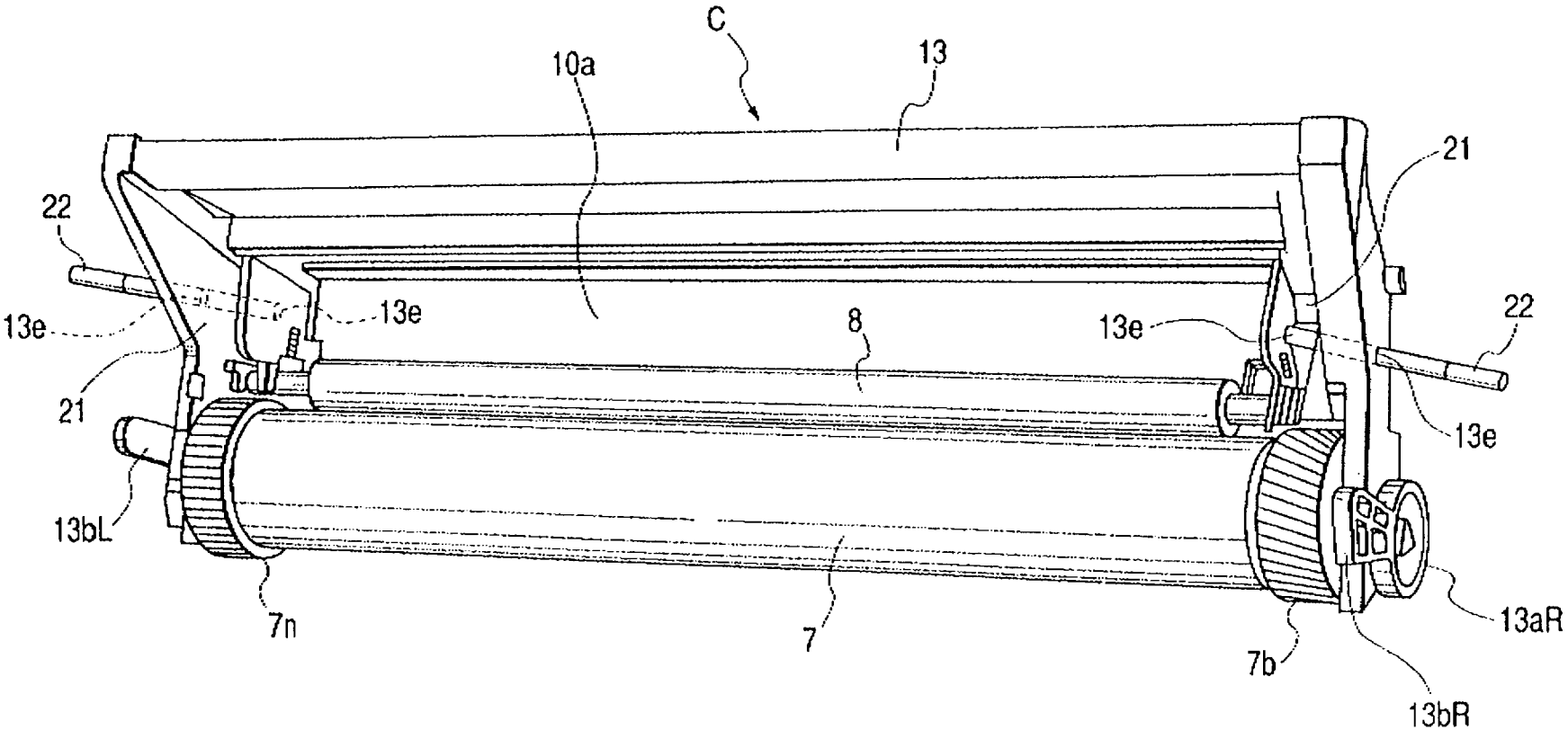
FIG. 12 is an explanatory perspective view showing a cleaning unit of a process cartridge.

In addition, as shown in FIGS. 2 and 12, the photosensitive drum 7, the charging roller 8 and the cleaning means 10 are each attached to the cleaning frame 13 to constitute a cleaning unit C as a first frame.

Figure 13:
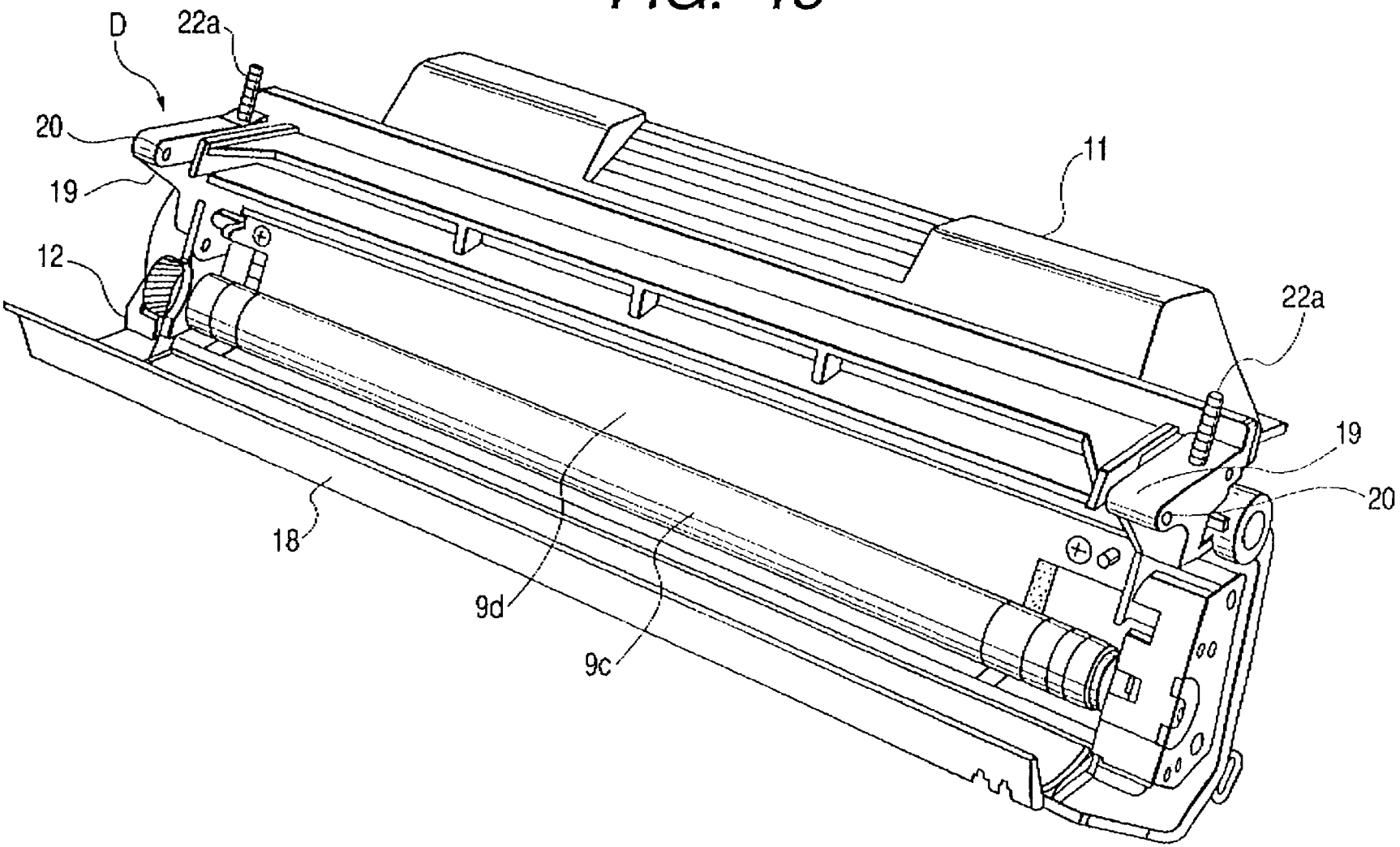
FIG. 13 is an explanatory perspective view showing a developing unit of the process cartridge.
Figure 14:
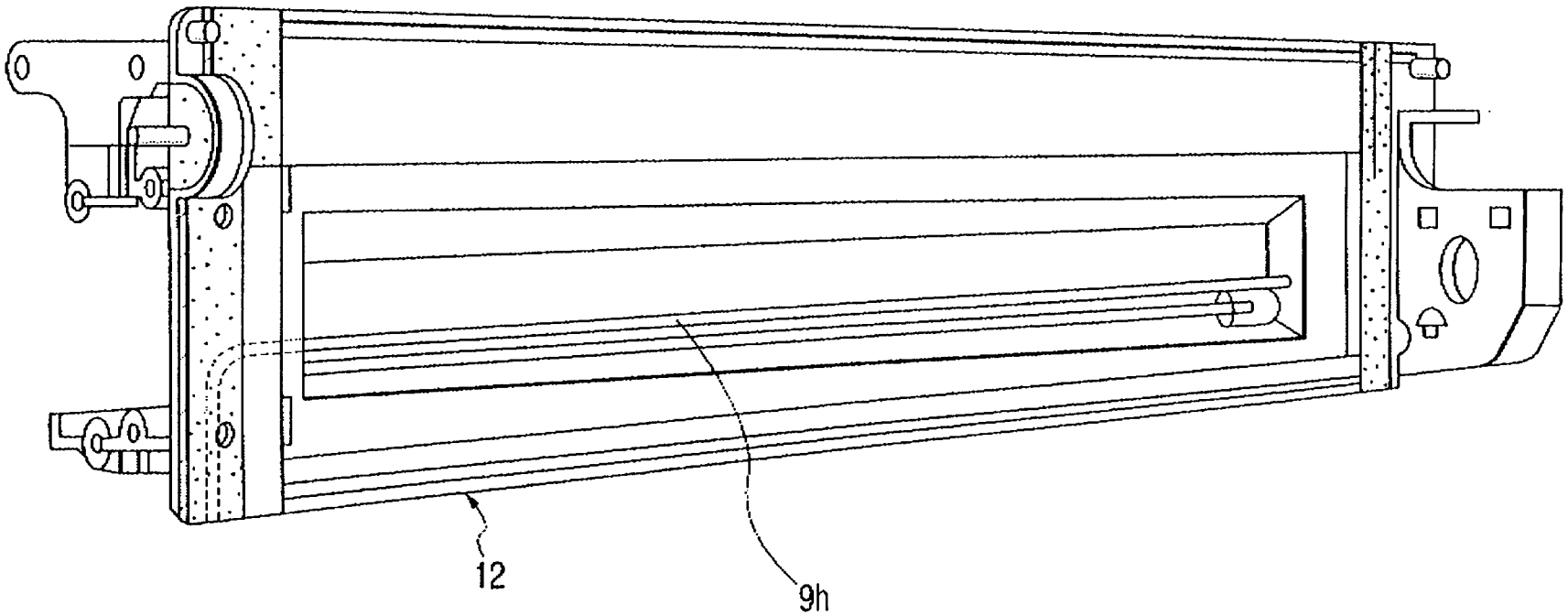
FIG. 14 is an explanatory perspective view of the developing unit of FIG. 13 from which a developing roller and a developing blade are removed.
Figure 15:
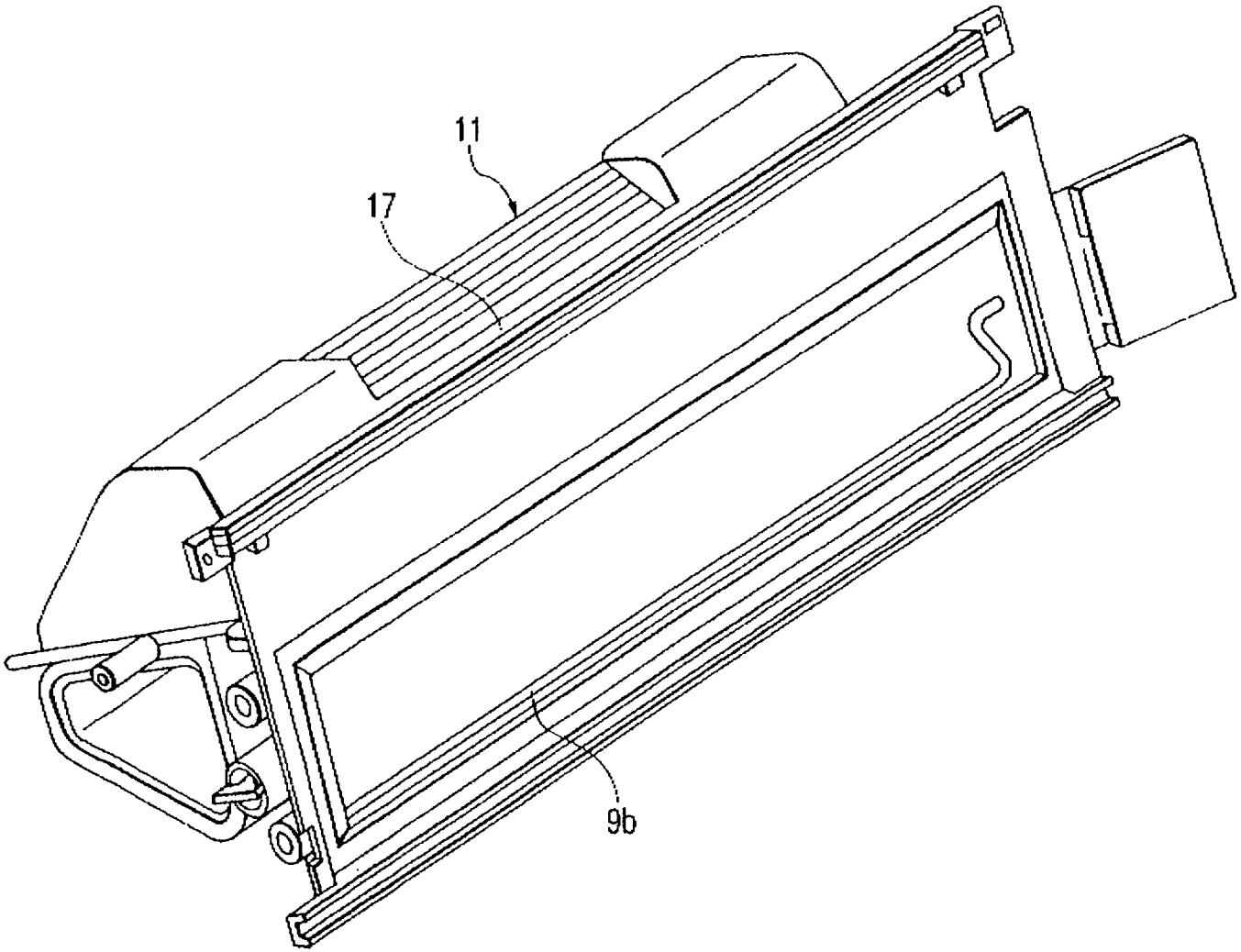
FIG. 15 is an explanatory perspective view showing a toner container unit of the process cartridge.

Then, the developing unit D and the cleaning unit C are rotatably connected to each other by connecting members 22 of a circular pin, whereby the process cartridge B1 is constituted. That is, as shown in FIG. 13, circular rotation holes 20 are provided in parallel with the developing roller 9*c* at the distal ends of arm portions 19 formed on both sides in the longitudinal direction (an axial direction of the developing roller 9*c*) of the developing frame 12. On the other hand, as shown in FIG. 12, concave portions 21 for allowing the arm portions 19 to enter are provided in two parts on both sides in the longitudinal direction of the cleaning frame 13. The arm portions 19 are inserted into the recesses 21, the connecting members 22 are force-fitted into attaching holes 13*e* of the cleaning frame 13 and are inserted into the rotation holes 20 at the ends of the arm portions 19 and in turn are force-fitted into further inside holes 13*e*, whereby the developing unit D and the cleaning unit C are connected rotatably around the connecting members 22. At this time, compression coil springs 22*a* inserted onto and attached to dowels (not shown) protrudingly provided at the proximal end of the arm portions 19 hit the upper wall of the recesses 21 of the cleaning frame 13 and the developing frame 12 is biased downward by the compression coil springs 22*a*, whereby the developing roller 9*c* is surely pressed against the photosensitive drum 7.

[Configuration of Guiding Means of the Process Cartridge]

Next, guiding means for mounting and detaching the first and the second process cartridges B1 and B2 to and from the first and the second apparatus main bodies 14 and 214 will be described.

Note that, the means for guiding the second process cartridge B2 to the second apparatus main body 214 is identical with the means for guiding the first process cartridge B1 to the first apparatus main body 14. Thus, by describing the latter, a description of the former is omitted. Therefore, the distinction of "first" and "second" is also omitted here.

Incidentally, the guiding means for acting as a guide in mounting and detaching the process cartridge B1 to and from the apparatus main body 14 are provided on both external sides of the cleaning frame 13 as shown in FIGS. 3 to 6. The guiding means are composed of cylindrical guides (convex portions) 13*a*R and 13*a*L as guide member for positioning and detent guides 13*b*R as a guide member being posture holding means in mounting and detaching the process cartridge B1.

Figure 4:
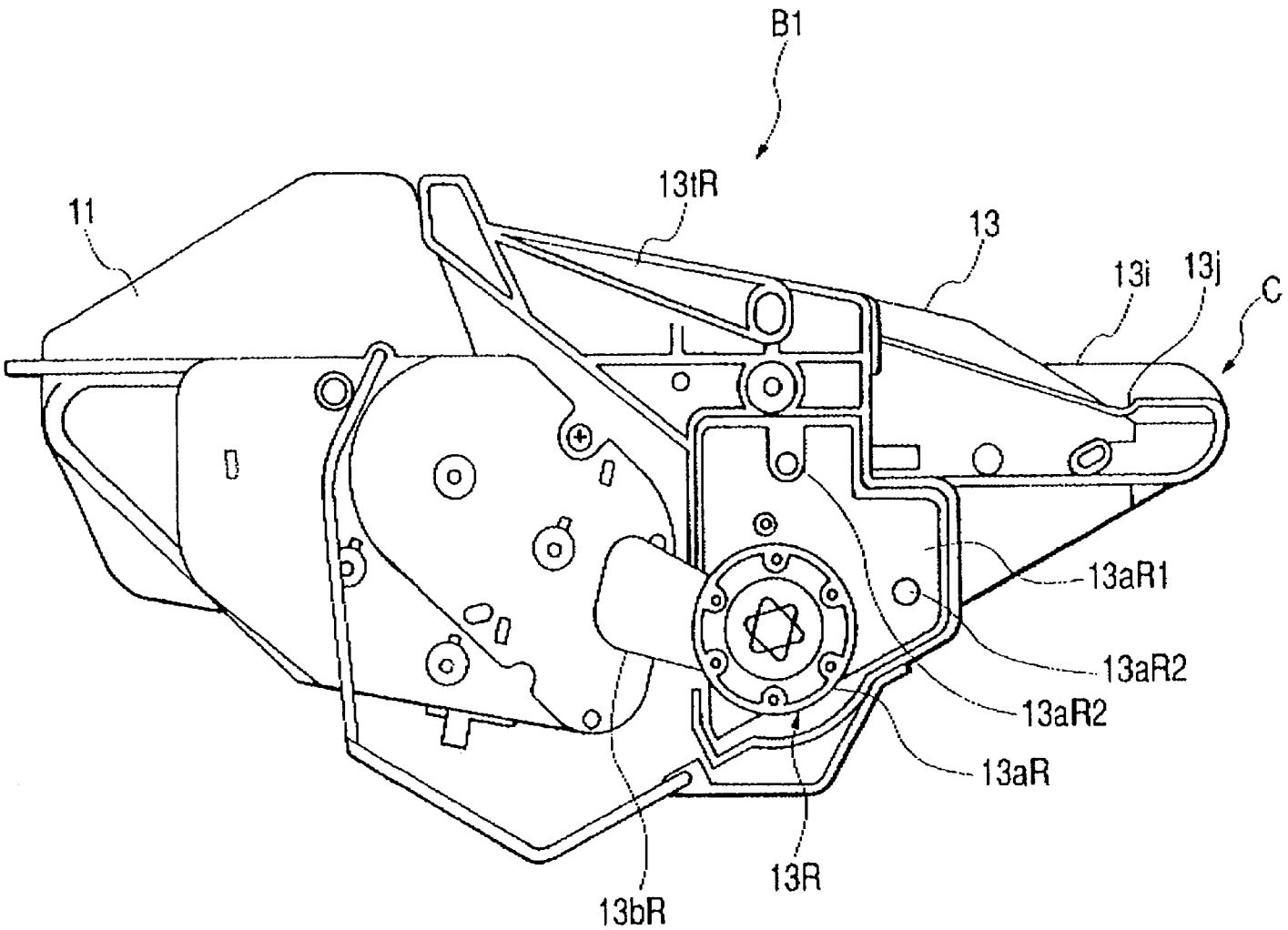
FIG. 4 is a right side view of the first process cartridge.

As shown in FIG. 4, the cylindrical guide 13*a*R is a hollow cylindrical member and the detent guide 13*b*R is integrally formed with the cylindrical guide 13*a*R and protrudes from the circumference of the cylindrical guide 13*a*R substantially in the radial direction. The cylindrical guide 13*a*R is provided integrally with an attaching flange 13*a*R1.

In this way, a right side guide member 13R having the cylindrical guide 13*a*R, the detent guide 13*b*R and the attaching flange 13*a*R1 are screwed in and fixed to the cleaning frame 13 by screws 13*a*R2 through screw-holes of the attaching flange 13*a*R1. The detent guide 13*b*R of the right side guide member 13R fixed to the cleaning frame 13 is disposed on the side of the developing frame 12 so as to extend toward the side of a development holder to be described later fixed to the developing frame 12.

Figure 5:
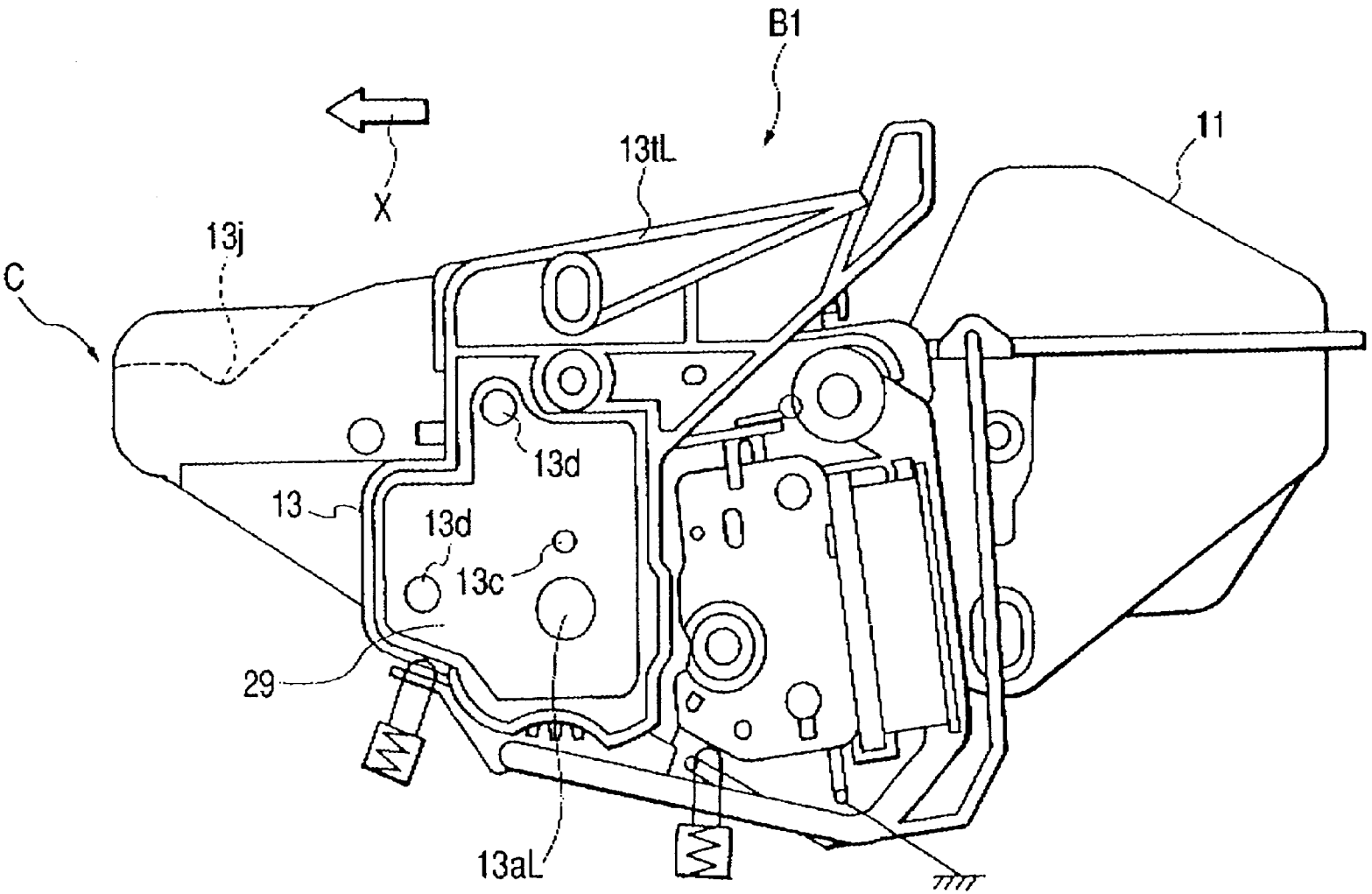
FIG. 5 is a lest side view of the first process cartridge.
Figure 6:
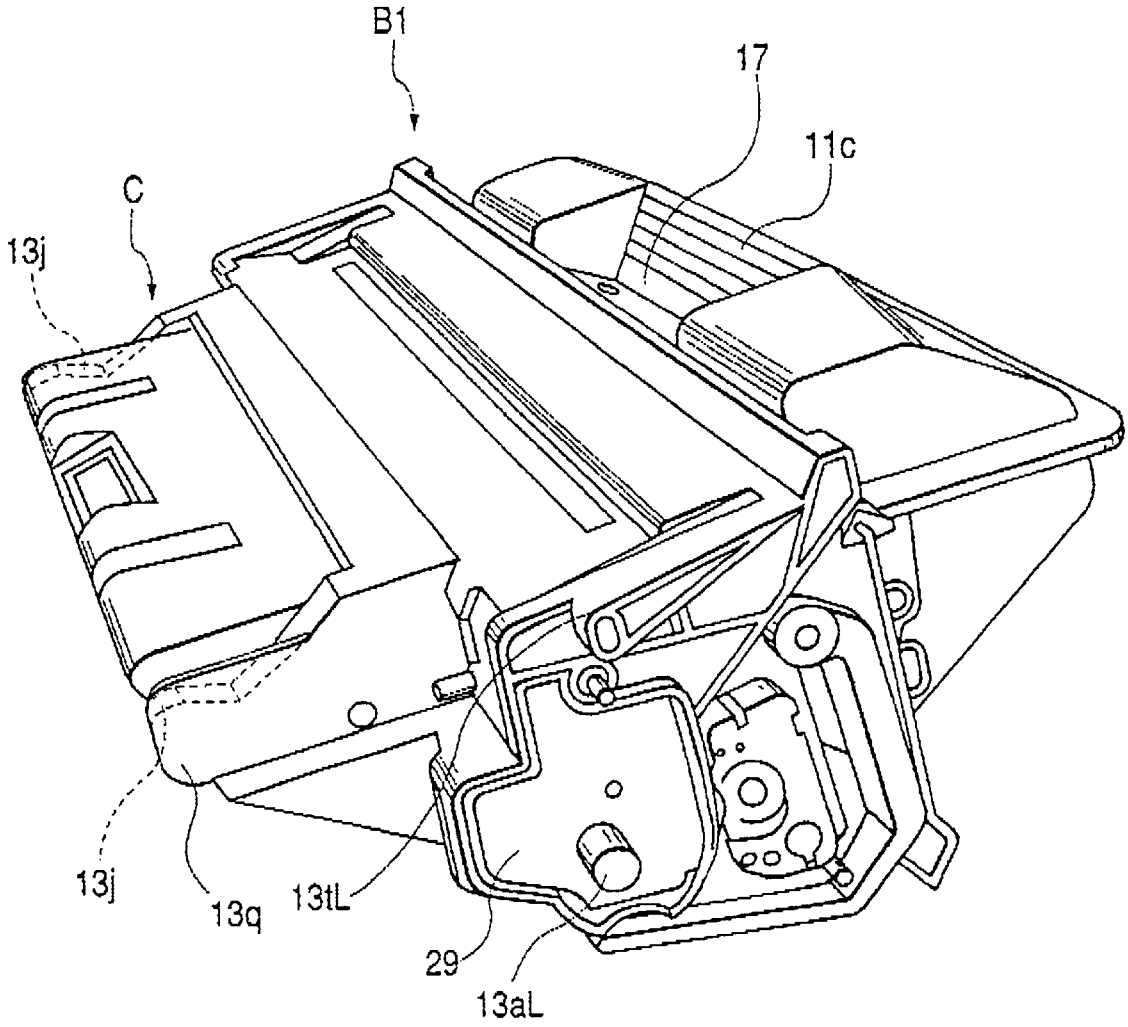
FIG. 6 is a perspective view of the first process cartridge as looking from an upper left-hand side.
Figure 7:
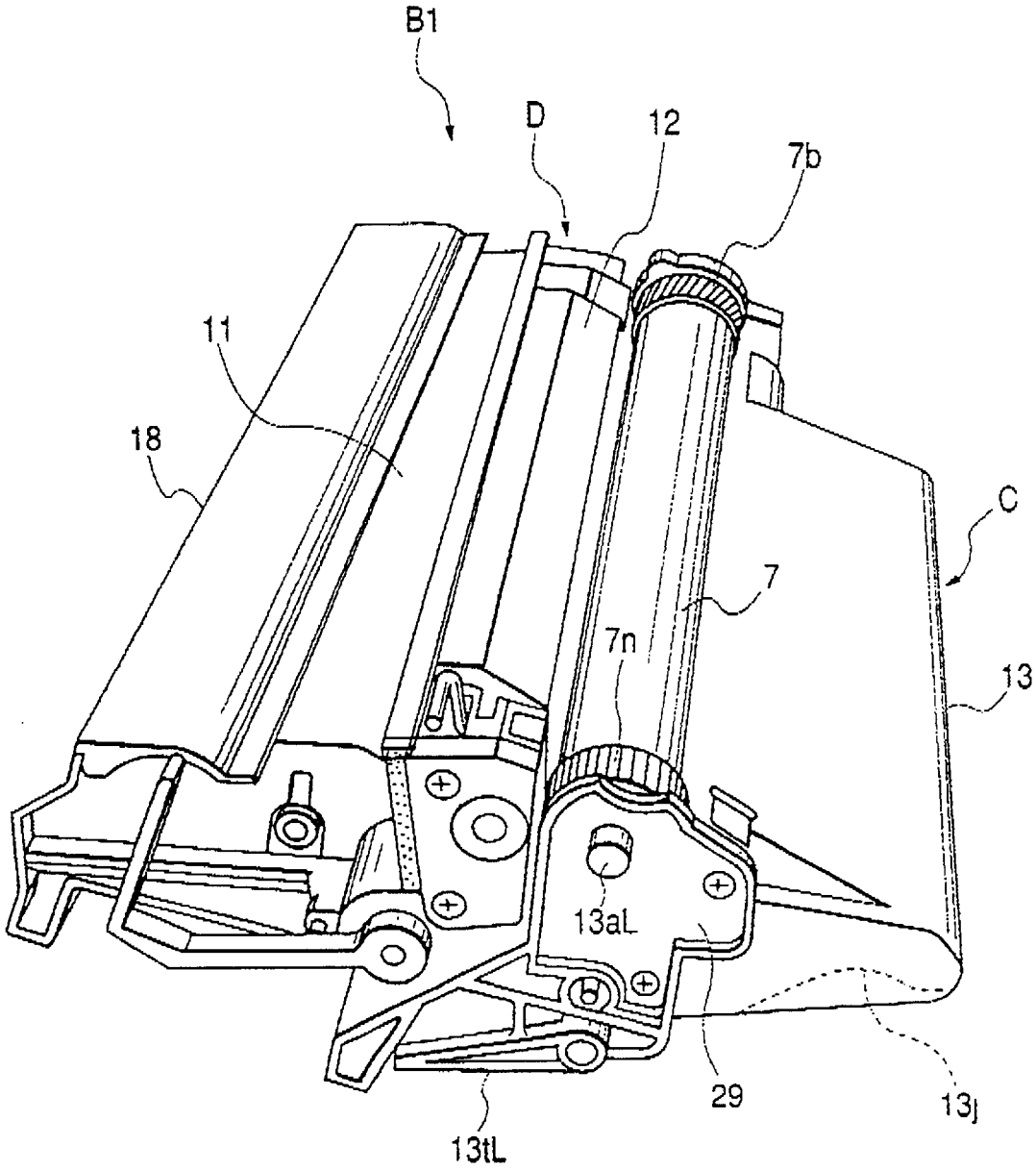
FIG. 7 is a perspective view of the first process cartridge turned over as looking from the upper left-hand side.
Figure 11:
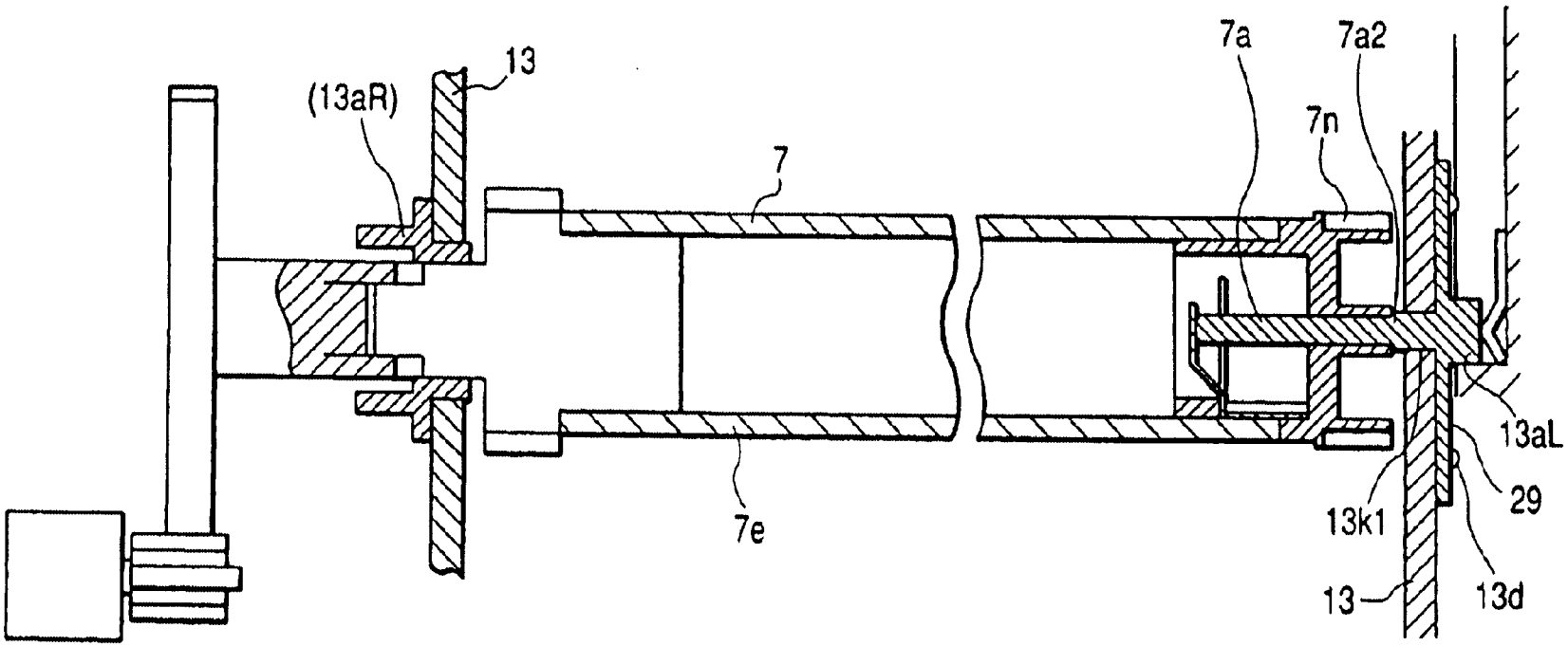
FIG. 11 is a sectional view showing a supporting portion of a photosensitive drum.

As shown in FIG. 11, an enlarged diameter portion 7*a*2 of a drum shaft 7*a* which is a rotating shaft of the photosensitive drum 7 fits in a hole 13*k*1 of the cleaning frame 13. Then, as shown in FIG. 5, the cylindrical guide 13*a*L is protrudingly provided toward the outsider (to the front direction perpendicular to the plane of the drawing of FIG. 5) on a flat flange 29 that fits a positioning pin 13*c* protruding toward the side of the cleaning frame 13 to be stopped rotating and is fixed to the cleaning frame 13 by screws 13*d*. Referring to FIG. 11 again, the fixed drum shaft 7*a* for rotatably supporting a spur gear 7*n* fitted in the photosensitive drum 7 is provided on the inward side or the flange 29. The cylindrical guide 13*a*L and the drum shaft 7*a* are coaxial. Note that, the flange 29, the cylindrical guide 13*a*L and the drum shaft 7*a* are integral or integrally manufactured with a metal material such as an iron material.

Next, with reference to FIGS. 3 to 6, regulating abutment portions 13*j* provided on an upper surface 13*i* of the cleaning unit C will be described. Here, the upper surface is a surface positioned in the upper part of the cartridge when the process cartridge B1 is mounted to the apparatus main body 14.

In the embodiment, the regulating abutment portions 13*j* are provided on a right end 13*p* and a left end 13*q* in the direction perpendicular to the direction for mounting a process cartridge on the upper surface 13*i* of the cleaning unit C, respectively.

The regulating abutment portions 13*j* are portions for regulating the position of the process cartridge B1 when, the process cartridge B1 is mounted to the apparatus main body 14. That is, when the process cartridge B1 is mounted to the first apparatus main body 14, the regulating abutment portions 13*j* abut against fixed members 25 (see FIGS. 8, 9 and 10) provided in the apparatus main body 14, whereby a rotational position of the process cartridge B1 around the cylindrical guides 13*a*R and 13*a*L is regulated, that is, the process cartridge B1 is positioned.

Next, the guiding means on the apparatus main body 14 side will be described with reference mainly to FIGS. 8 and 9.

Figure 8:
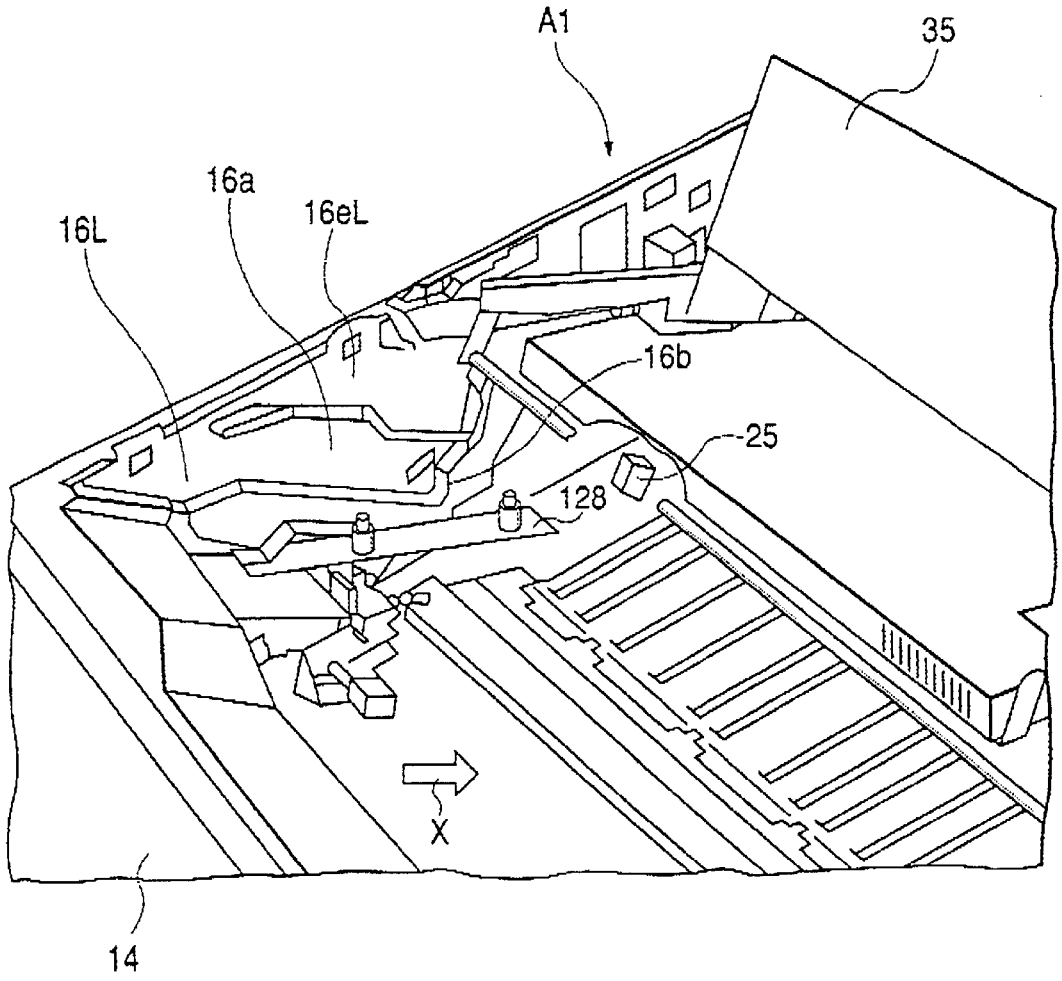
FIG. 8 is a perspective view showing a left side or a process cartridge mounting portion of a first image forming apparatus main body.
Figure 9:
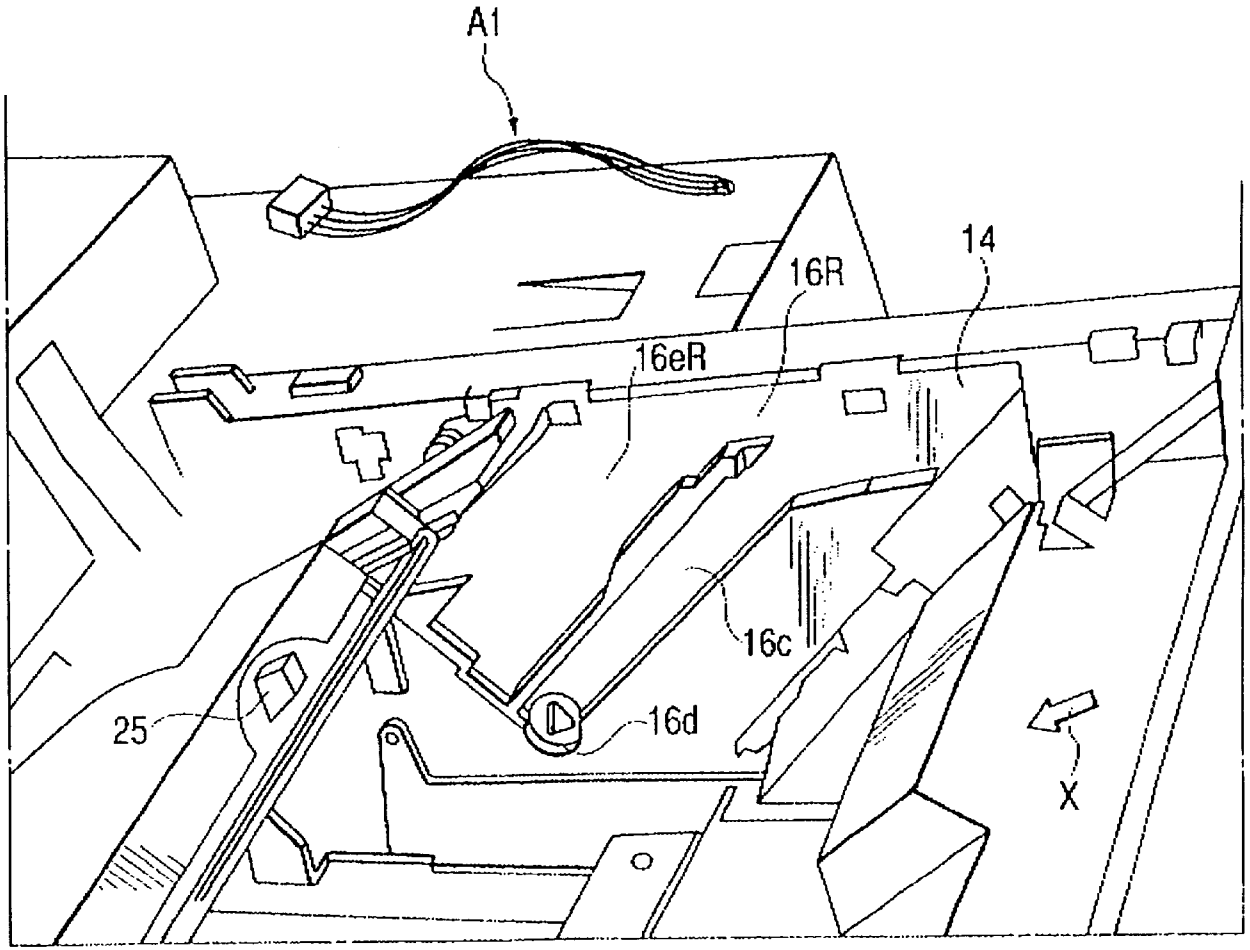
FIG. 9 is a perspective view showing a right side of the process cartridge mounting portion of the first image forming apparatus main body.

As shown in FIG. 1, when an opening and closing member 35 of the apparatus main body 14 is rotated counterclockwise around a fulcrum 35*a* in FIG. 1, the upper part of the apparatus main body 14 is opened and the mounting means for mounting the process cartridge B1 is seen as shown in FIGS. 8 and 9. Guiding members 16L and 16R are each provided on internal walls of both left and right sides of the apparatus main body 14 as is seen from the opening when the opening and closing member 35 is opened. That is, the guiding member 16L is provided on the left side as shown in FIG. 8 and the guiding member 16P is provided on the right side as shown in FIG. 9, as viewed from the mounting and detaching direction (indicated by the arrow X) of the process cartridge B1.

The guiding members 16*k* and 16L are respectively provided with guiding portions 16*a* and 16*c* that are provided in an inclined manner so as to forwardly descend, as viewed from the direction indicated by the arrow X in which the process cartridge B1 is inserted into the apparatus main body, and semicircular positioning grooves (positioning portions) 16*b* and 16*d* that lead to the guiding portions 16*ea* and 16*c*, respectively, and in which the cylindrical guides 13*a*R (FIG. 3) and 13*a*L (FIG. 5) of the process cartridge B1 securely fit. The positioning grooves 16*b* and 16*d* have peripheral walls of a cylindrical shape. The centers of the positioning grooves 16*b* and 16*d* align with the centers of the cylindrical guides 13*a*R and 13*a*L of the process cartridge B1 and accordingly also align with the central line of the photosensitive drum 7 when the process cartridge B1 is mounted to the apparatus main body 14.

The guiding portions 16*a* and 16*c* have widths sufficient for the cylindrical guides 13*a*R and 13*a*L to fit therein, as viewed from the mounting and detaching direction of the process cartridge B1. The detent guide 13*b*R having a smaller width than the diameter of the cylindrical guide 13*a*R loosely fits in the guiding portion naturally. However, the rotation of the cylindrical guides 13*a*R and 13*a*L and the detent guide 13*b*R are regulated by the guiding portions 16*a* and 16*c*, and the process cartridge B1 is mounted maintaining a posture within a fixed range.

Figure 10:
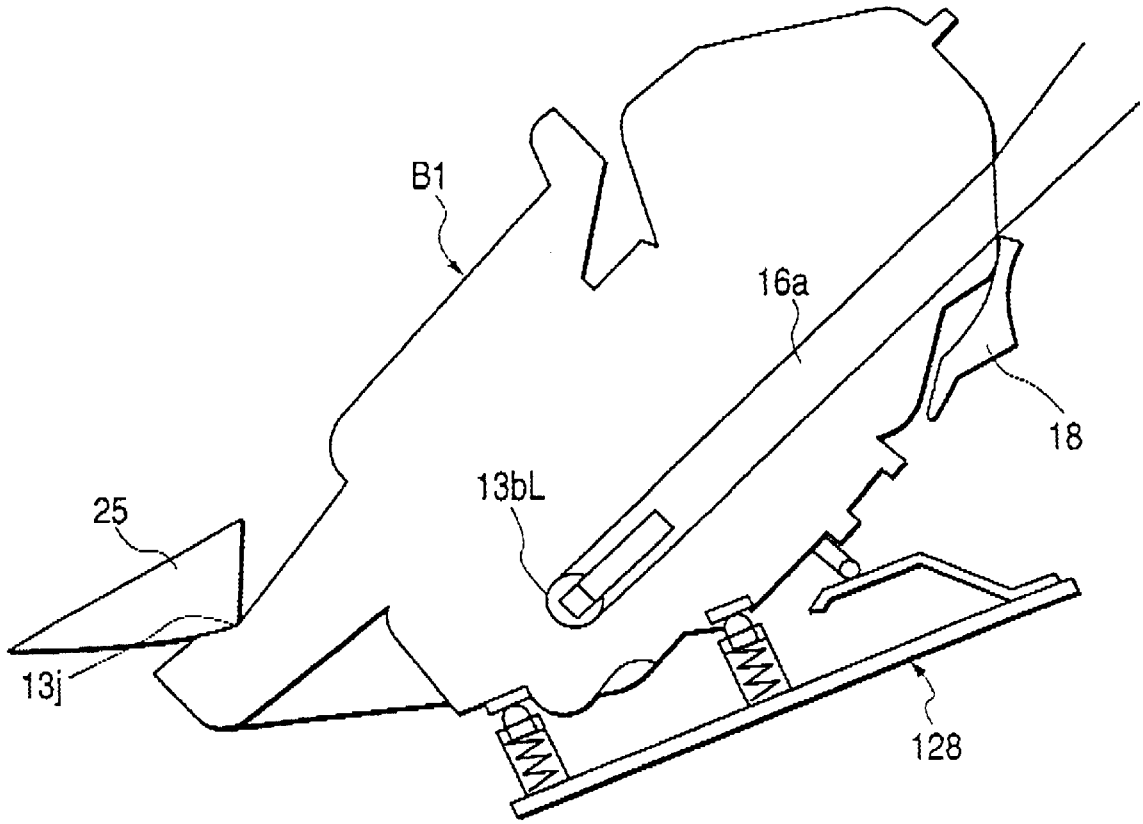
FIG. 10 is a sectional view showing the process cartridge mounting portion of the first image forming apparatus main body.

In the state in which the process cartridge B1 is mounted to the apparatus main body 14, the cylindrical guides 13*a*R and 13*a*L of the process cartridge B1 fit in the positioning grooves 16*b* and 16*d* of the guide member 13R and a comparable guide member on the left side of the cartridge, respectively. Then, the regulating abutment portions 13*j* on left and right of the tip in the cleaning frame 13 of the process cartridge B1 are made to abut against the fixed members 25 of the apparatus main body 14. In addition, as shown in FIG. 10, the process cartridge B1 is supported by an elastic supporting mechanism 128 provided in the apparatus main body 14 at the bottom portion of the process cartridge B1.

The above-mentioned process cartridge B1 is subject to weight distribution with respect to a central line connecting the centers of the cylindrical guides 13*a*R 13*a*L such that the developing unit D side has a larger primary moment than the cleaning unit C side when the central line is kept level.

When the process cartridge B1 is to be mounted to the apparatus main body 14, ribs 11*c* on each of a concave portion 17 side and the lower side of the toner frame 11 are gripped by one hand of a user. Then, the cylindrical guides 13*a*R and 13*a*L are inserted into the guiding portions 16*a* and 16*c* of the cartridge mounting portion of the apparatus main body 14, respectively, and subsequently the process cartridge B1 is made to forwardly descend, as viewed from the inserting direction to insert the detent guides 13*b*R into the guiding portions 16*a* and 16*c* of the apparatus main body 14.

The cylindrical guides 13*a*R and 13*a*L and the detent guides 13*b*R of the process cartridge B1 are moved deep into the apparatus main body 14 along the guiding portions 16*a* and 16*c* of the apparatus main body 14. Then, when the cylindrical guides 13*a*R and 13*a*L of the process cartridge B1 reach the positioning grooves 16*b* and 16*d* of the apparatus main body 14, the cylindrical guides 13*a*R and 13*a*L are seated in the positions of the positioning grooves 16*b* and 16*d* with the aid of the weight of the process cartridge itself.

In this way, the cylindrical guides 13*a*R and 13*a*L of the first process cartridge B1 are accurately positioned with respect to the positioning grooves 16*b* and 16*d*. Then, since the central line connecting the enters of the cylindrical guides 13*a*R and 13*a*L is the central line of the photosensitive drum 7, the photosensitive, arum 7 is substantially positioned in the apparatus main body 14. Finally, the photosensitive drum 7 is positioned in the apparatus main body 14 in the state in which couplings of a driving system are coupled.

In this state, there is a slight gap between the fixed members 25 of the apparatus main body 14 and the regulating abutment portions 13*j* of the process cartridge B1. Here, when the hand holding the process cartridge 31 is released, the developing unit D side of the process cartridge B1 moves down and the cleaning unit C side moves up around the cylindrical guides 13*a*R and 13*a*L. The regulating abutment portions 13*j* of the process cartridge B1 abut against the fixed members 25 of the apparatus main body 14, whereby the process cartridge B1 is mounted to the apparatus main body 14 accurately. Thereafter, the apparatus main body 14 is closed by turning the opening and closing member 35 clockwise around the fulcrum 35*a* in FIG. 1.

On the other hand, in an inverse manner from the above, for removing the process cartridge B1 from the apparatus main body 14, the opening and closing member 35 of the apparatus main body 14 is opened and the above-mentioned upper and lower ribs 11*c* forming grip portions are lifted by a hand. In this way, the cylindrical guides 13*a*R and 13*a*L of the process cartridge B1 rotate around the positioning grooves 16*b* and 16*d* of the apparatus main body 14, whereby the regulating abutment portions 13*j* of the process cartridge B1 are released from the fixed members 25 of the apparatus main body 14.

When the process cartridge B1 is further pulled, the cylindrical guides 13*a*R and 13*a*L are pulled out of the positioning grooves 16*b* and 16*d* to be moved to the guiding portions 16*a* and 16*c* of the guiding member 16R and the comparable guiding member on the left side of the cartridge fixed to the apparatus main body 14. Then, as the process cartridge B1 as it stands is lifted up, the cylindrical guides 13*a*R and 13*a*L and the detent guides 13*b*R and 13*b*L of the process cartridge B1 are moved upwardly through the guiding portions 16*a* and 16*c*. Consequently, the posture of the process cartridge B1 is regulated and the process cartridge B1 is taken out of the apparatus main body 14 without hitting other parts of the apparatus main body 14.

Further, as shown in FIG. 12, the spur gear 7*n* is provided in an end portion on the opposite side of a helical drum gear 7*b* in the axial direction of the photosensitive drum 7. The spur gear 7*n* engages with a gear (not shown), which is coaxial with the transfer roller 4 provided in the apparatus main body 14, when the process cartridge B1 is mounted to the apparatus main body 14, and the spur gear 7*n* transmits a driving force for rotating the transfer roller 4 from the process cartridge B1 to the transfer roller 4 through the gear.

The guide configuration in mounting the first and the second process cartridges B1 and B2 to the first and the second image forming apparatuses A1 and A2 in accordance with the embodiment is as described above.

[Compatible Configuration of a Process Cartridge and an Image Forming Apparatus Main Body]

Next, a compatible configuration between a process cartridge and an apparatus main body, which is a characteristic part of the present invention, will be described. Note that, in the drawings referred to in the following description, like members of the second process cartridge have the prefix 100 when compared to the arrangements of the first process cartridge. In addition, like members of the second apparatus main body have the prefix 200 when compared to the arrangements in the first apparatus main body.

As described above, the first process cartridge B1 is a cartridge for a medium to low speed image forming apparatus (the first image forming apparatus A1) and the second process cartridge B2 is for a high speed image forming apparatus (the second image forming apparatus A2).

Thus, for example, rotary members, such as a photosensitive drum, a developing sleeve and an agitating member as well as gears and the like for transmitting driving forces to the rotary members, which constitute the second process cartridge B2, rotate faster than those in the first process cartridge B1. Therefore, a special member (with high durability, abrasive resistance or the like) is used for a sliding portion of the second process cartridge B2, and the sliding portion is greased or a ball bearing or the like is used for the sliding portion. However, these members are not used because these members are naturally expensive, and it results in an excessive specification if the members are used for the first process cartridge B1 for a medium to low speed machine that does not need the members, which leads to an increase in costs.

As described above, when an optimal design is carried out while promoting sharing of components and cross-sectional shapes in order to shorten the manufacturing cycle and reduce the costs of components and units by the economics of scale, the shapes of the first and the second process cartridges B1 and B2 and the shapes of the first and the second apparatus main bodies 14 and 214 become very similar.

Here, if the first process cartridge B1 is mounted to the second apparatus main body 214, since the sliding portion of the first process cartridge B1 is not formed to be able to cope with the speed of the second apparatus main body 214, the sliding portion is abraded due to enduring this mismatch over time. On the contrary, if the second process cartridge B2 is mounted to the first apparatus main body 14, no problem occurs.

Thus, as a measure for preventing the above-mentioned problem from occurring, the present invention is configured such that the second process cartridge B2 for a high speed machine is mountable to the first and the second apparatus main bodies 14 and 214 and the first process cartridge B1 for a medium to low speed machine is mountable only to the first apparatus main body 14 and is unmountable to the second apparatus main body 214.

A specific configuration of the present invention will be described below.

As shown in FIGS. 3 to 7, guide ribs 13*t*R and 13*t*L are provided on both sides in the longitudinal direction of the first process cartridge B1, respectively. Further, as shown in FIGS. 8 and 9, flat portions 16*e*R and 16*e*L are provided on the internal wall surfaces on both sides of the first apparatus main body 14 to oppose the guide ribs 13*t*R and 13*t*L when the process cartridge B1 is mounted.

Figure 16:
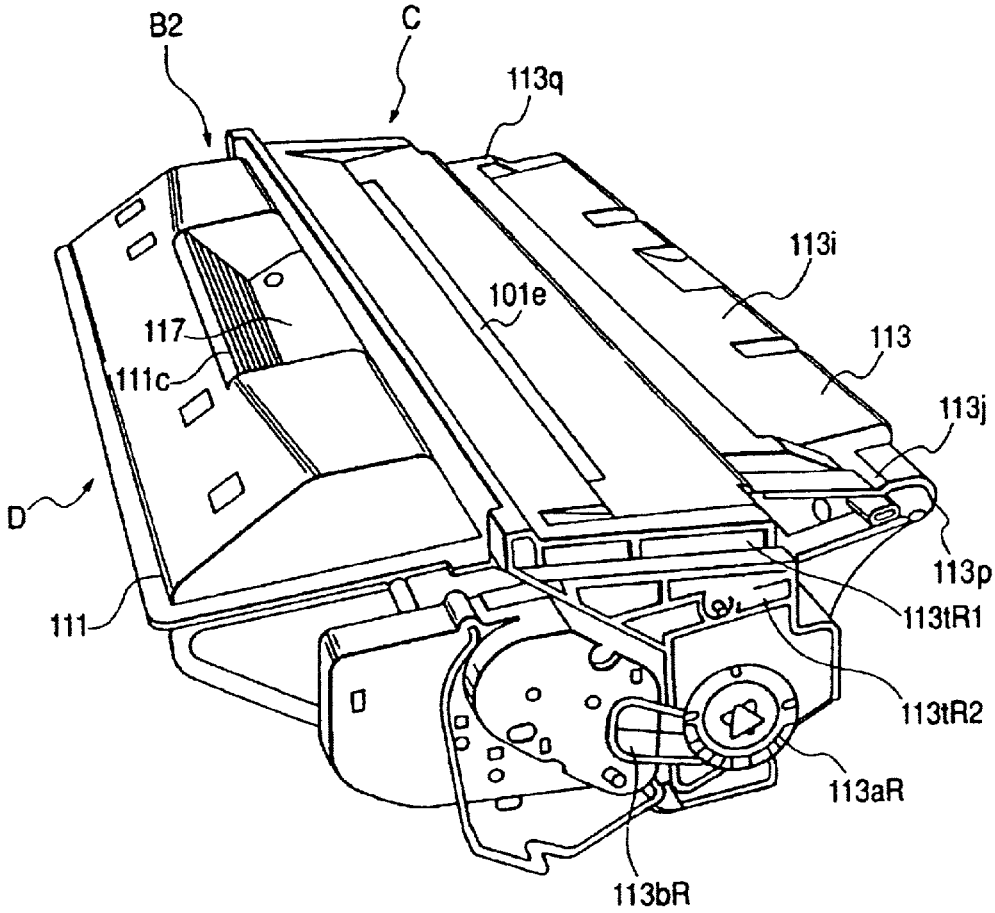
FIG. 16 is a perspective view of a second process cartridge as looking from an upper right-hand side.
Figure 17:
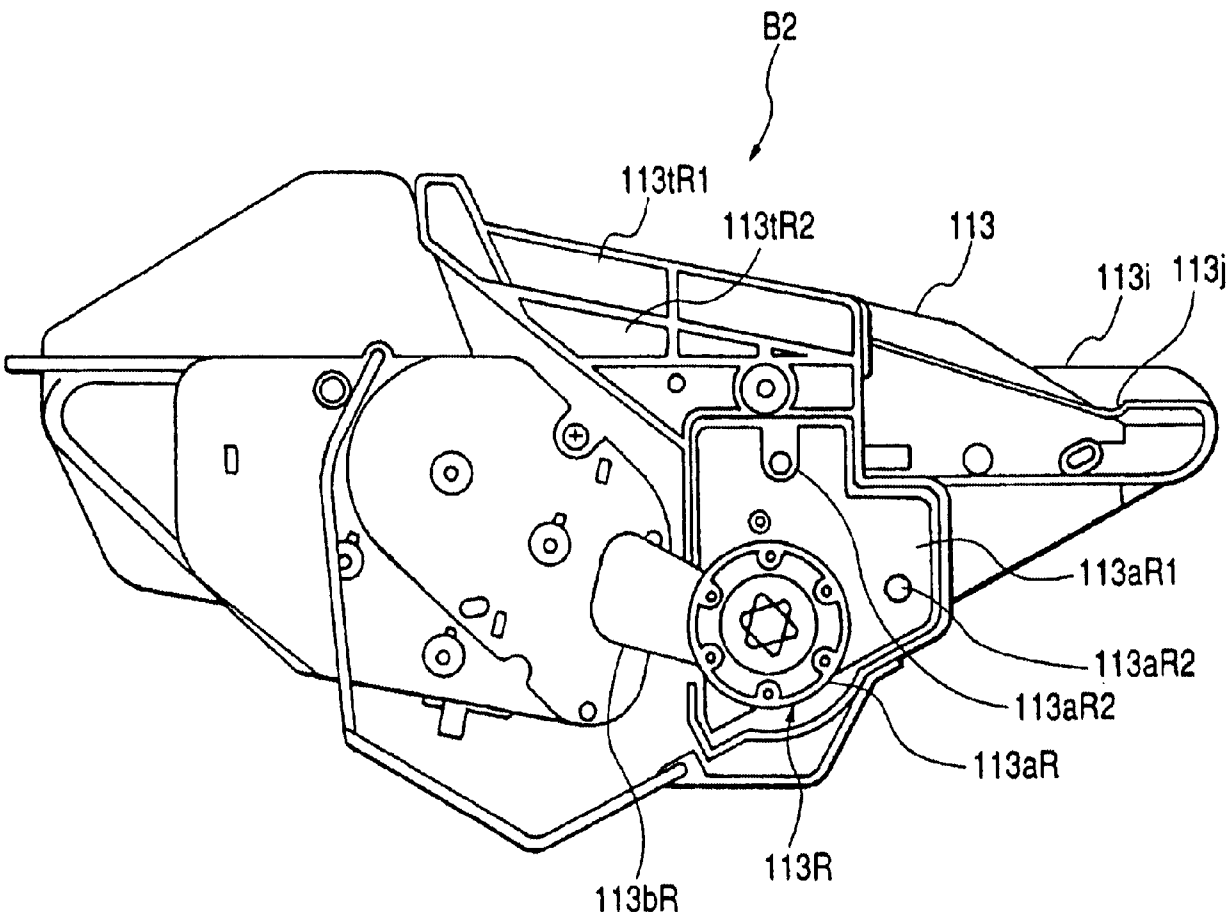
FIG. 17 is a right side view of the second process cartridge.
Figure 18:
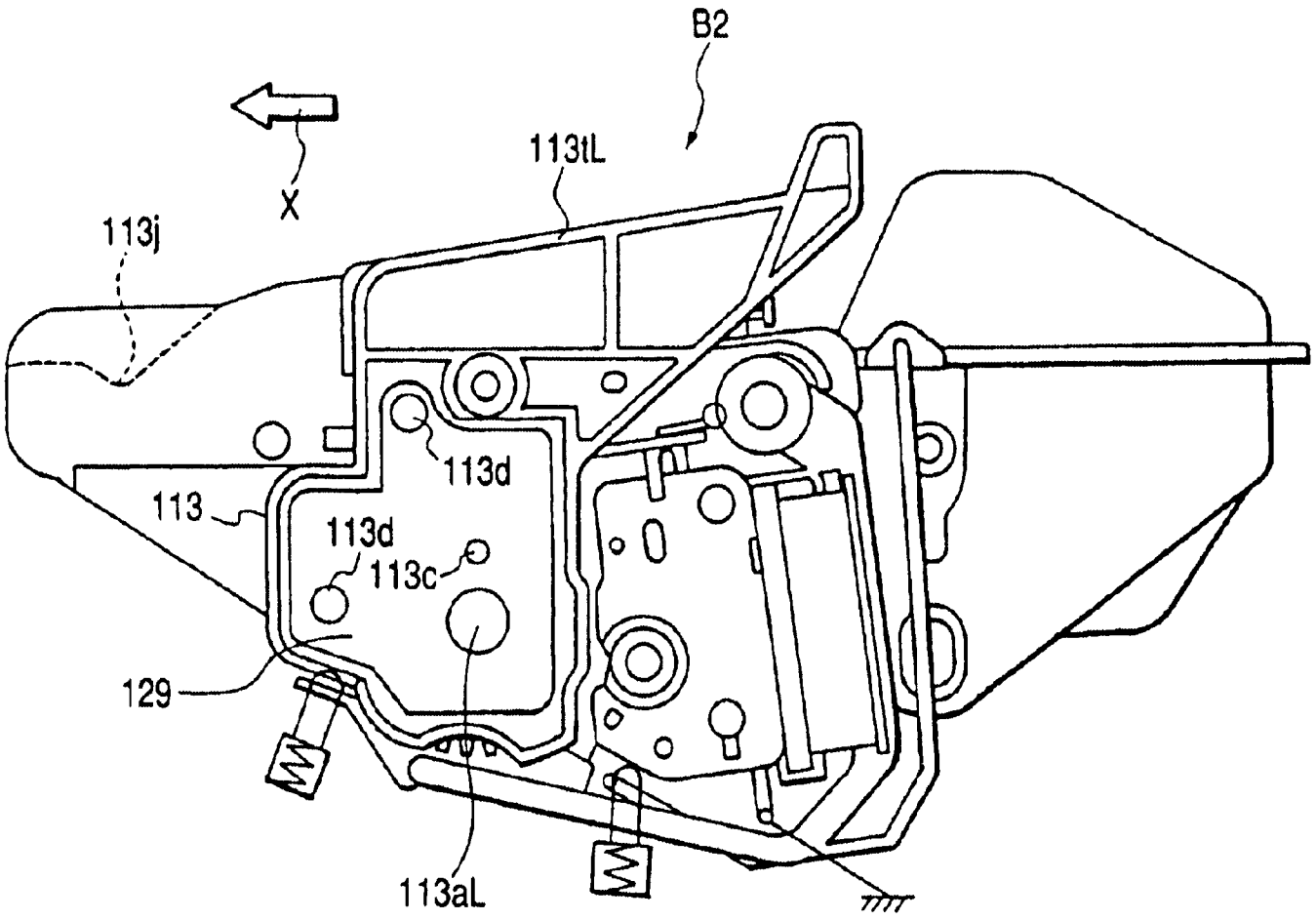
FIG. 18 is a left side view of the second process cartridge.
Figure 19:
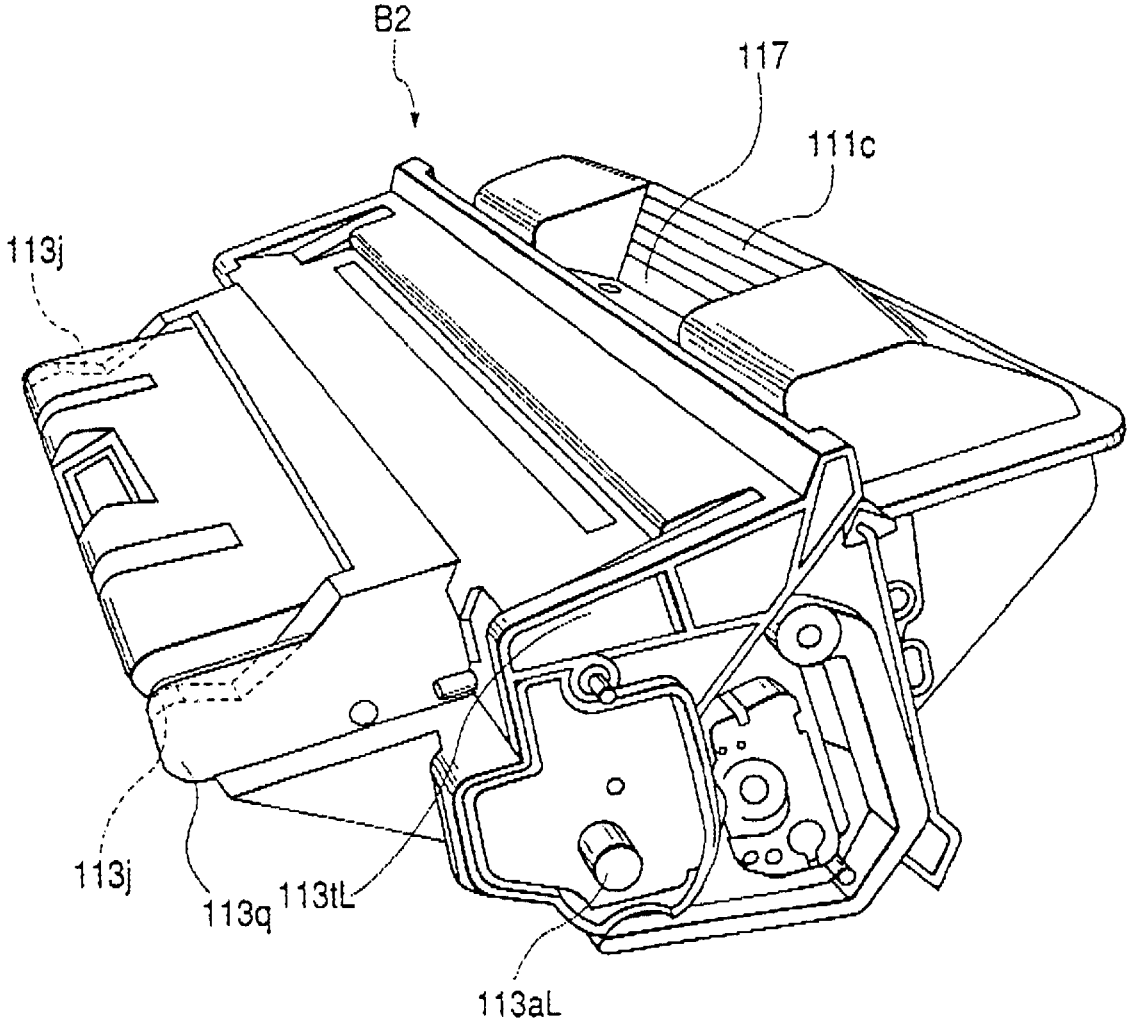
FIG. 19 is a perspective view of the second process cartridge as looking from an upper left-hand side.
Figure 20:
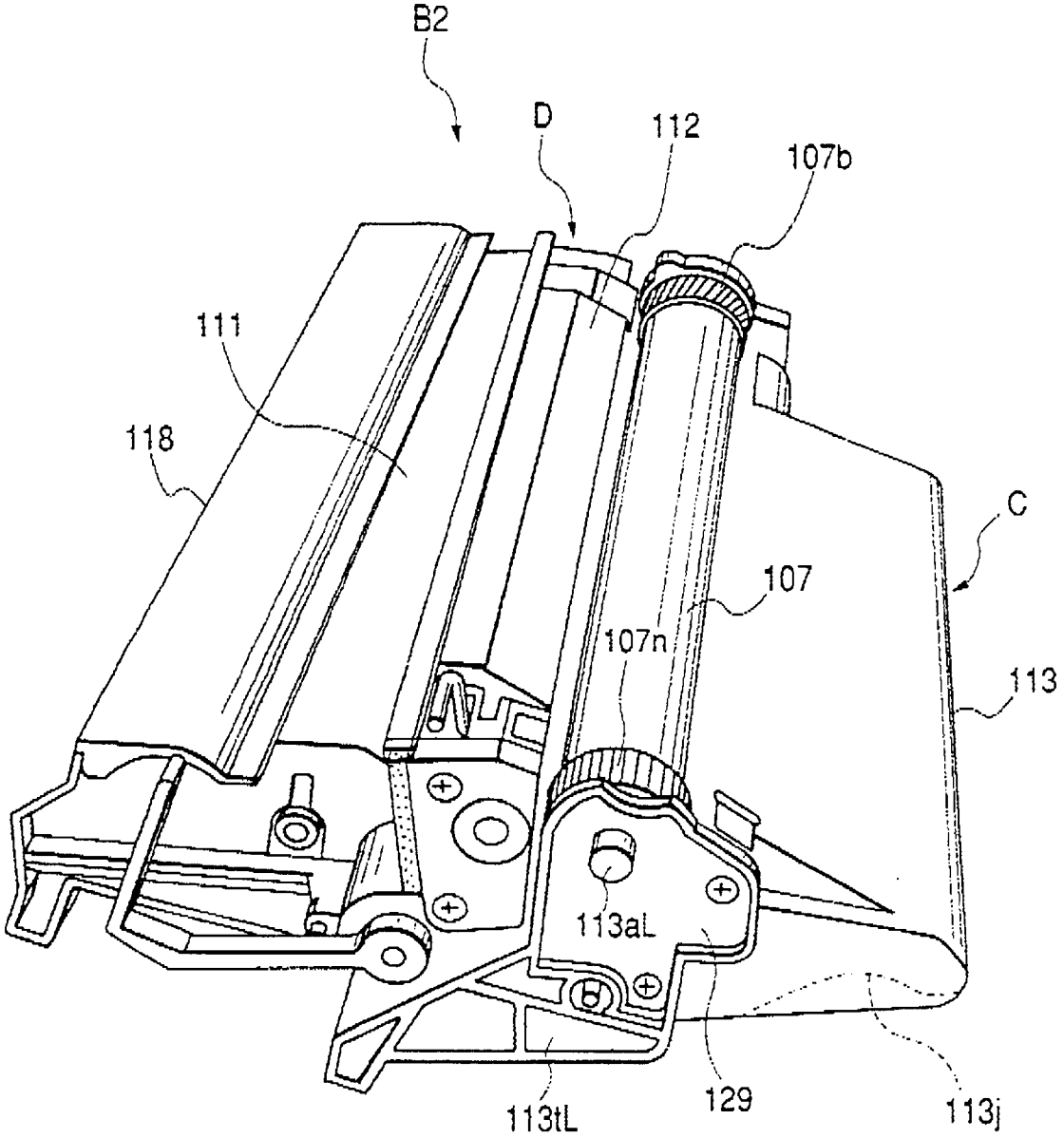
FIG. 20 is a perspective view of the second process cartridge turned over as looking from the upper left-hand side.

On the other hand, as shown in FIGS. 16 and 17, a concave portion (concave area) 113*t*R1 and a flat portion 131*t*R2 are provided on the right side of the second process cartridge B2. In addition, as shown in FIG. 18, a flat portion 113*t*L is provided on the left side. The guide ribs 13*t*R and 13*t*L as provided in the first process cartridge B1 do not exist on both sides of the second process cartridge B2. Note that, the above-mentioned concave portion 113*t*R1 is configured by cutting off a cleaning frame 113 from the out side to the inside on its side.

Figure 21:
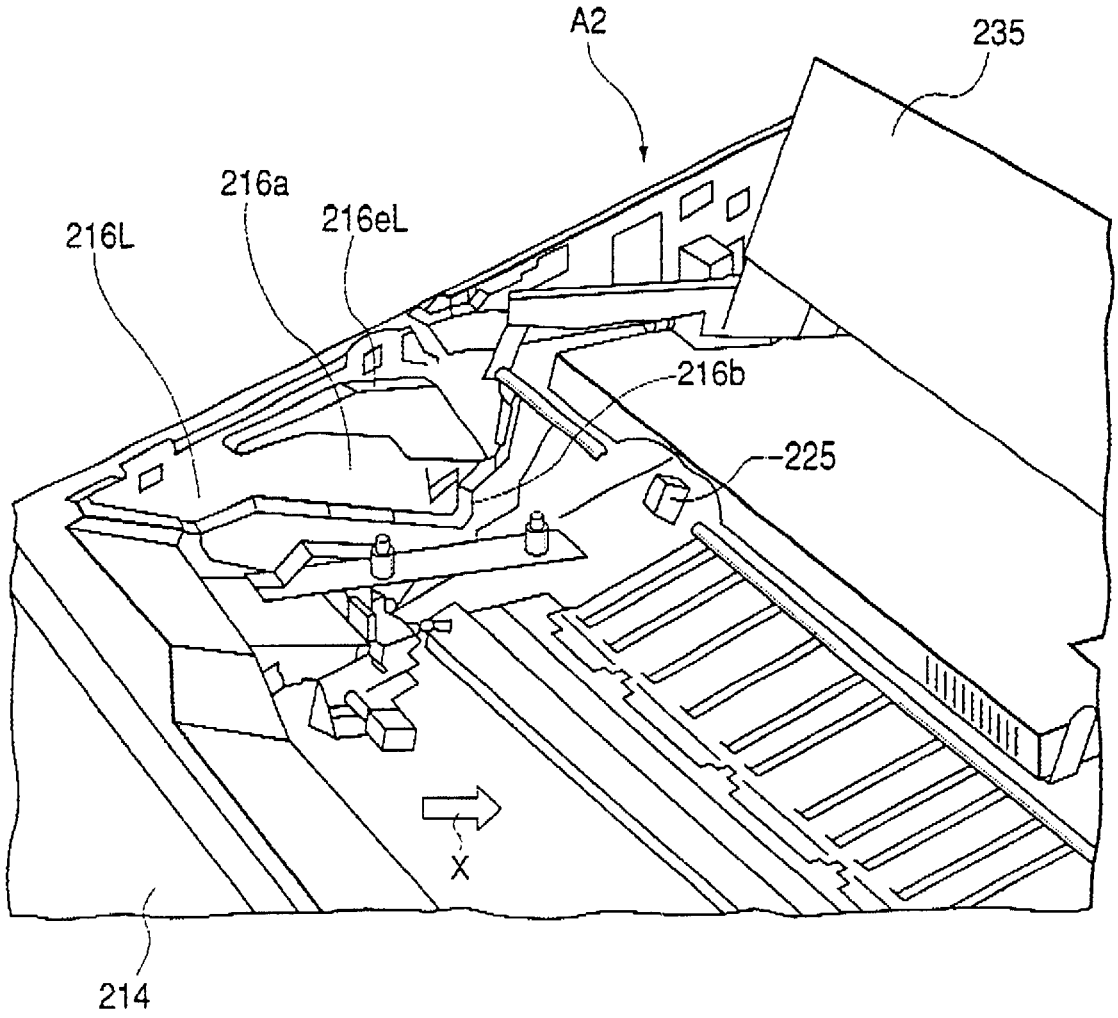
FIG. 21 is a perspective view showing a left side of a process cartridge mounting portion of a second image forming apparatus main body.
Figure 22:
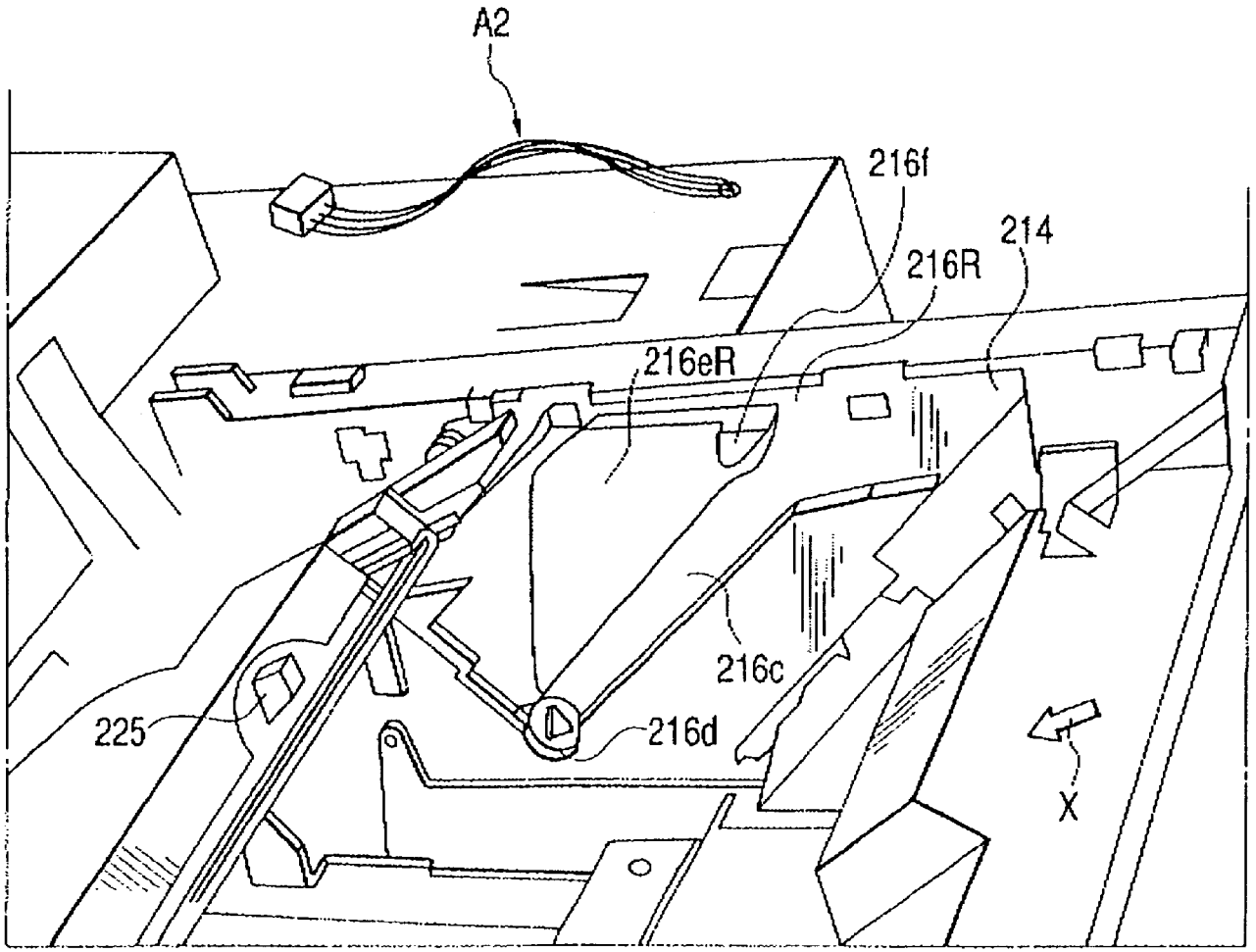
FIG. 22 is a perspective view showing a right side of the process cartridge mounting portion of the second image forming apparatus main body.

Then, as shown in FIGS. 21 and 22, respectively, the second apparatus main body 214 is provided with a flat member 2716*e*L, a flat member 216*c*R and a protrusion 216*f* protruding from the flat member 216*e*R, each of which respectively oppose the flat portion 113*t*L, the flat portion 113*t*R2 and the concave 113*t*P1, when the second process cartridge B2 is mounted.

Further, the plate members 216*e*L and 216*e*R provided in the second apparatus main body 214 are formed in a shape rising in the longitudinal direction of the process cartridge B2 to be mounted from the flat portions 16*e*L hand 16*e*R in the first apparatus main body 14.

Next, a compatible configuration between the first and the second process cartridges and the first and the second apparatus main bodies will be described with reference to FIGS. 23A, 23B, 23C and 23D that schematically illustrates the configuration.

Figure 23A:
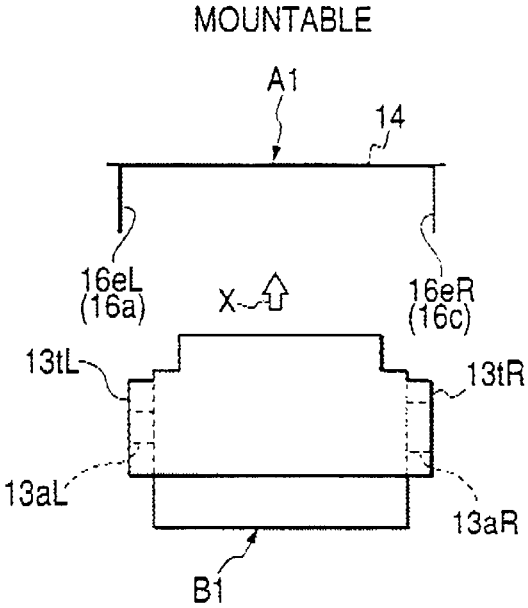
FIGS. 23A, 23B, 23C and 23D are schematic views for explaining a compatible configuration between a process cartridge and an image forming apparatus main body.

As shown in FIG. 23A, when the first process cartridge B1 is inserted initial the first apparatus main body 14, the guide ribs 13*t*L and 13*t*R of the first process cartridge B1 are guided along the flat portions 16*e*L and 16*e*R in the first apparatus main body 14 and the first process cartridge B1 is mounted to the first apparatus main body 14.

Figure 23C:
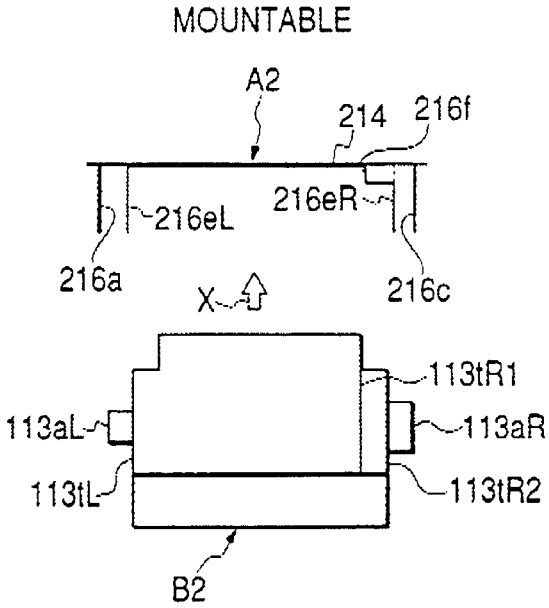
Figure 23B:
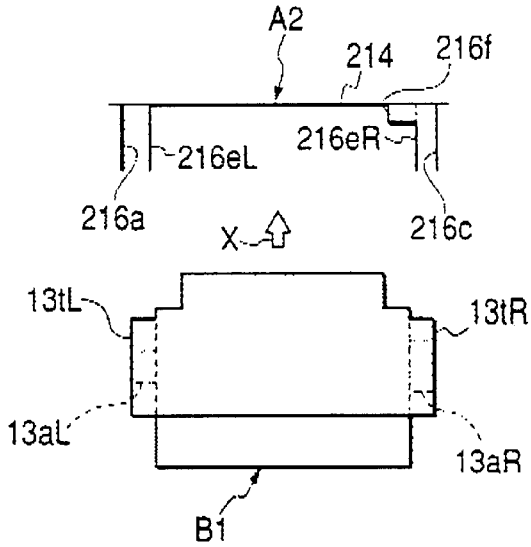

As shown in FIG. 23B, when it is attempted to insert the first process cartridge B1 into the second apparatus main body 214, the first process cartridge B1 cannot be inserted because the guide ribs 13*t*R and 13*t*L of the first process cartridge B1 interfere with the flat members 216*e*L and 216*e*R of the second apparatus main body 214 in the width direction. On the other hand, even if it is attempted to insert the first process cartridge B1 by force, it cannot be mounted to the second apparatus main body 214 because the protrusion 216*f* protrudingly provided in the flat member 216*e*R interferes with the guide rib 13*t*R in the inserting direction.

In addition, the protrusion 216*f* is provided in the vicinity of an entrance for inserting a process cartridge in the second apparatus main body 214. That is, it; is immediately after the first process cartridge B1 starts to be mounted to the second apparatus main body 214 that the protrusion 216*f* interferes with the first process cartridge B1 (guide rib 13*t*R). Thus, it is possible to have a user to instantly notice that the first process cartridge B1 is not-mountable to the second apparatus main body 214 and prevent the process cartridge or the image forming apparatus main body from being damaged by the user who tries to insert the first process cartridge B1 into the second apparatus main body 214 by force.

As shown in FIG. 23C, when the second process cartridge B2 is mounted to the second apparatus main body 214, even if the protrustion 216*f* is provided in the second apparatus main body 214, the second process cartridge B2 can be mounted by avoiding the protrusion 216*f*.

Figure 23D:
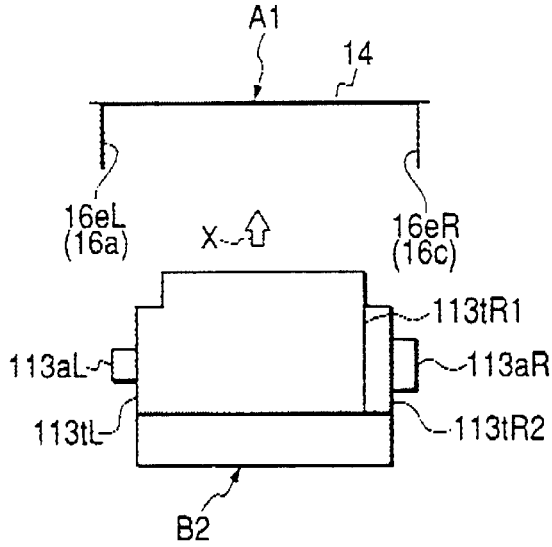

Next, when the second process cartridge B2 is mounted to the first apparatus main body 14, as shown in FIG. 23D, there is no portion than interferes with the second process cartridge B2. Thus, the second process cartridge B2 can be mounted in the same manner as the first process cartridge B1 and normal printing can be performed.

As described above, according to the embodiment, it is possible to configure the second process cartridge B2 for a high speed machine to be mountable to the first and the second apparatus main bodies 14 and 214 and the first process cartridge B1 for a medium to low speed machine to be mountable only to the first apparatus main body 14 and not-mountable to the second apparatus main body 214.

Therefore, the abrasion of a sliding portion due to use for a long period or the abrasion of a sliding portion of a rotating shaft of a photosensitive drum or a developing sleeve that is caused in a case where the first process cartridge B1 is mounted to the second apparatus main body 214 can be prevented.

As described above, the process cartridge and the image forming apparatus of the present invention enables a process cartridge of different performance to be not-mountable to the image forming apparatus if the process cartridge cannot sufficiently cope with performance of the image forming apparatus. For example, a process cartridge of low speed performance can be made not-mountable and a process cartridge of high speed performance can be made mountable. Therefore, abrasion or the like of a sliding portion in a process cartridge that cannot cope with performance of the image forming apparatus can be prevented.

In addition, since a convex portion provided in the image forming apparatus is located substantially in the entrance of an inserting portion of a process cartridge, a user can determine whether the cartridge is mountable or not at an instance when the user attempts to mount the process cartridge into the image forming apparatus main body. Thus, the image forming apparatus main body or the process cartridge cannot be damaged by inserting a not-mountable process cartridge by force.

While the invention has been described with reference to the structure disclosed herein, it is not confined to the details set forth and this application is intended to cover such modifications or changes as may come within the purposes of the improvements or the scope of the following claims.

What is claimed is:

1. A process cartridge detachably mountable to an electrophotographic image forming apparatus main body, said process cartridge comprising:

an electrophotographic photosensitive drum;

process means for acting on said electrophotographic photosensitive drum;

a frame configured and positioned to hold said electrophotographic photosensitive drum;

convex portions, which are provided coaxially with an axis of said electrophotographic photosensitive drum and protrude from one side and from the other side of said frame, so as to position said process cartridge in the electrophotographic image forming apparatus main body when said process cartridge is mounted to the electrophotographic image forming apparatus main body; and a concave portion provided in an upper part of said frame and recessed in said one side thereof, wherein said concave portion allows said process cartridge to be inserted into the electrophotographic image forming apparatus main body without abutting against a protrusion provided in the electrophotographic image forming apparatus main body during an inserting process of inserting said process cartridge into the electrophotographic image forming apparatus main body.

2. A process cartridge according to claim 1, wherein said concave portion does not abut against all members constituting mounting means of the electrophotographic image forming apparatus main body during the inserting process of inserting said process cartridge into the electrophotographic image forming apparatus main body.

3. A process cartridge according to claim 1, wherein said concave portion allows said process cartridge to be inserted into the electrophotographic image forming apparatus main body without abutting against the protrusion provided in the electrophotographic image forming apparatus main body, and wherein when a process cartridge different in performance from said process cartridge is to be inserted into the electrophotographic image forming apparatus main body, the protrusion abuts against the process cartridge different in performance to prevent the process cartridge different in performance from being inserted into the electrophotographic image forming apparatus main body.

4. A process cartridge detachably mountable to an electrophotographic image forming apparatus main body, said process cartridge comprising:

an electrophotographic photosensitive drum;

process means for acting on said electrophotographic photosensitive drum;

a frame configured and positioned to hold said electrophotographic photosensitive drum; and a concave portion provided in an upper part of said frame and recessed in one side thereof, wherein said concave portion allows said process cartridge to be inserted into the electrophotographic image forming apparatus main body without abutting against a protrusion provided in the electrophotographic image forming apparatus main body during an inserting process of inserting said process cartridge into the electrophotographic image forming apparatus main body, wherein when a process cartridge different in performance from said process cartridge is to be inserted into the electrophotographic image forming apparatus main body, the protrusion abuts against the process cartridge different in performance to prevent the process cartridge different in performance from being inserted into the electrophotographic image forming apparatus main body.

5. A process cartridge according to claim 3 or 4 wherein a process speed of said process cartridge having said concave portion is higher than a process speed of the process cartridge different in performance.

6. A process cartridge according to any one of claims 1, 2 or 5 further comprising at least one of charging means as said process means for charging said electrophotographic photosensitive drum, developing means as said process means for carrying developer to said electrophotographic photosensitive drum, and cleaning means as said process means for cleaning said electrophotographic photosensitive drum.

7. An electrophotographic image forming apparatus, to which a process cartridge is detachably mountable, for forming and image on a recording medium, said electrophotographic image forming apparatus comprising:

(a) a protrusion provided on an internal wall surface of a main body of said electrophotographic image forming apparatus;

(b) mounting means for detachably mounting the process cartridge, wherein the process cartridge includes an electrophotographic photosensitive drum, process means for acting on the electrophotographic photosensitive drum, a frame configured and positioned to hold the electrophotographic photosensitive drum, convex portions, which are provided coaxially with an axis for the electrophotographic photosensitive drum and protrude from one side and from the other side of the frame, so as to position the process cartridge in said main body when the process cartridge is mounted to said main body, and a concave portion provided in an upper part of the frame and recessed in the one side thereof, wherein the concave portion allows the process cartridge to be inserted into said main body without abutting against said protrusion during an inserting process of inserting the process cartridge in said main body; and (c) conveying means for conveying the recording medium.

8. An electrophotographic image forming apparatus according to claim 7, wherein said protrusion is provided substantially in an entrance of a process cartridge inserting portion of said main body.

9. An electrophotographic image forming apparatus according to claim 7, wherein when a process cartridge different in performance from the process cartridge is to be inserted into said main body, said protrusion abuts against the process cartridge different in performance to prevent the process cartridge different in performance from being inserted into said main body.

10. A process cartridge detachable mountable to an electrophotographic image forming apparatus main body, the electrophotographic image forming apparatus main body being provided with mounting means comprising a guiding portion that is provided on an internal wall surface of the electrophotographic image forming apparatus main body so as to guide said process cartridge to a predetermined position, a positioning portion configured and positioned to position said process cartridge in the predetermined position, and a protrusion provided on the internal wall surface, said process cartridge comprising:

an electrophotographic photosensitive drum;

process means for acting on said electrophotographic photosensitive drum;

a frame configured and positioned to hold said electrophotographic photosensitive drum;

convex portions, which are provided coaxially with an axis of said electrophotographic photosensitive drum and protrude from one side and from the other side of said frame, so as to position said process cartridge in the positioning portion of the electrophotographic image forming apparatus main body when said process cartridge is mounted to the electrophotographic image forming apparatus main body; and a concave portion provided in an upper part of said frame and recessed in said one side thereof, wherein said concave portion allows said process cartridge to be inserted into the electrophotographic image forming apparatus main body without abutting against the protrusion and against the guiding portion during an inserting process of inserting said process cartridge into the electrophotographic image forming apparatus main body.

11. A process cartridge according to claim 10, wherein when a process cartridge different in performance from said process cartridge is to be inserted into the electrophotographic image forming apparatus main body, the protrusion and the guiding portion about against the process cartridge different in performance to prevent the process cartridge different in performance from being inserted into the electrophotographic image forming apparatus main body.

12. A process cartridge according to claim 11, wherein a process speed of said process cartridge having said concave portion is higher than a process speed of the process cartridge different in performance.

13. A process cartridge according to claim 10 or 12, further comprising at least one of charging means as said electrophotographic photosensitive drum, developing means as said process means for carrying developer to said electrophotographic photosensitive drum, and cleaning means as said process means for cleaning said electrophotographic photosensitive drum.

* * * * *

UNITED STATES PATENT AND TRADEMARK OFFICE

CERTIFICATE OF CORRECTION

PATENT NO. : 6,738,589 B2
DATED : May 18, 2004
INVENTOR(S) : Toshiyuki Karakama et al.

It is certified that error appears in the above-identified patent and that said Letters Patent is hereby corrected as shown below:

Column 2,
Line 2, “flew” should read -- new --.

Column 3,
Line 15, “lest” should read -- left --.

Column 4,
Line 35, “firs” should read -- first --.
Line 36, “aid” should read -- and --.

Column 6,
Line 4, “frame.” should read -- frame --.

Column 7,
Line 65, “when,” should read -- when --.

Column 8,
Line 65, “13aR” should read -- 13aR and --.

Column 9,
Line 25, “enters” should read -- centers --.
Line 27, “arum 7” should read -- drum 7” --.

Column 11,
Line 18, “out side” should read -- outside --.
Line 38, “initial” should read -- into --.
Line 56, “it;” should read -- it --.

Column 12,
Line 6, “than” should read -- that --.

Column 13,
Line 55, “or 5” should read -- and 5 --.
Line 64, “and” should read -- an --.

UNITED STATES PATENT AND TRADEMARK OFFICE

CERTIFICATE OF CORRECTION

PATENT NO. : 6,738,589 B2
DATED : May 18, 2004
INVENTOR(S) : Toshiyuki Karakama et al.

It is certified that error appears in the above-identified patent and that said Letters Patent is hereby corrected as shown below:

Column 14,
Line 32, “detachable” should read -- detachably --.

Column 15,
Line 2, “about” should read -- abut --.

Column 16,
Line 2, “as said” should read -- as said process means for changing said --.

Signed and Sealed this

Twenty-sixth Day of October, 2004

JON W. DUDAS
*Director of the United States Patent and Trademark Office*